US008422922B2

(12) United States Patent
Hayashi

(10) Patent No.: US 8,422,922 B2
(45) Date of Patent: Apr. 16, 2013

(54) TUBULAR BODY, TUBULAR BODY SUPPORTING APPARATUS, IMAGE FIXING APPARATUS, AND IMAGE FORMING APPARATUS

(75) Inventor: Shogo Hayashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 399 days.

(21) Appl. No.: 12/556,177

(22) Filed: Sep. 9, 2009

(65) Prior Publication Data

US 2010/0247169 A1 Sep. 30, 2010

(30) Foreign Application Priority Data

Mar. 24, 2009 (JP) ..... 2009-071533

(51) Int. Cl.
*G03G 15/01* (2006.01)
*G03G 15/20* (2006.01)

(52) U.S. Cl.
USPC ..... 399/302; 399/329

(58) Field of Classification Search ..... 399/328, 399/329
See application file for complete search history.

(56) References Cited

U.S. PATENT DOCUMENTS

| | | | | |
|---|---|---|---|---|
| 5,621,512 | A | 4/1997 | Uehara et al. | |
| 6,303,258 | B1 * | 10/2001 | Katoh et al. | 430/110.1 |
| 6,417,459 | B1 * | 7/2002 | Kanzaki et al. | 174/254 |
| 2002/0015602 | A1 | 2/2002 | Mochimaru et al. | |
| 2004/0058143 | A1 | 3/2004 | Tamemasa et al. | |
| 2005/0189628 | A1 | 9/2005 | Tamemasa et al. | |

FOREIGN PATENT DOCUMENTS

| | | |
|---|---|---|
| JP | A-3-12268 | 1/1991 |
| JP | A-05/281869 | 10/1993 |
| JP | A-6-313055 | 11/1994 |
| JP | A-9-227712 | 9/1997 |
| JP | A-2002-123098 | 4/2002 |
| JP | B2-3298354 | 4/2002 |
| JP | A-2002-229351 | 8/2002 |
| JP | A-2003-89166 | 3/2003 |
| JP | A-2004-255828 | 9/2004 |
| JP | A-2006-259248 | 9/2006 |
| JP | A-2007-193063 | 8/2007 |

OTHER PUBLICATIONS

Notice of Reasons for Rejection for corresponding Japanese Patent Application No. 2009-071533, mailed on Feb. 1, 2011 (w/ English translation).
Office Action issued in Japanese Patent Application No. 2009-071533 dated Jun. 14, 2011 (with translation).
Dec. 13, 2011 Office Action issued in Japanese Application No. 2009-071533 (with translation).

* cited by examiner

*Primary Examiner* — David Gray
*Assistant Examiner* — Gregory H Curran
(74) *Attorney, Agent, or Firm* — Oliff & Berridge, PLC

(57) ABSTRACT

A tubular body includes: a substrate including concave portions on a surface thereof; a surface layer formed on the surface of the concave portion-including side of the substrate; and a particle positioned at an interface between the substrate and the surface layer in each of the concave portions.

13 Claims, 8 Drawing Sheets

TUBULAR BODY, TUBULAR BODY SUPPORTING APPARATUS, IMAGE FIXING APPARATUS, AND IMAGE FORMING APPARATUS

CROSS-REFERENCE TO RELATED APPLICATIONS

This application is based on and claims priority under 35 USC 119 from Japanese Patent Application No. 2009-071533 filed Mar. 24, 2009.

BACKGROUND

1. Technical Field

The present invention relates to a tubular body, a tubular body supporting apparatus, an image fixing apparatus, and an image forming apparatus.

2. Related Art

In an image forming apparatus such as a copy machine or a printer that uses an electrophotographic method, a photoreceptor (photoreceptor drum) formed into, for example, a drum is charged, and the photoreceptor drum is exposed to light controlled based on image information to form an electrostatic latent image on the photoreceptor drum. Then, the electrostatic latent image is converted into a visual image (toner image) with a toner, the toner image is transferred onto a recording paper via, for example, an intermediate transfer medium, and the transferred toner image is fixed by use of a fixing unit to form an image.

SUMMARY

According to an aspect of the invention, there is provided a tubular body including:

a substrate including concave portions on a surface thereof;

a surface layer formed on the surface of the concave portion-including side of the substrate; and a particle positioned at an interface between the substrate and the surface layer in each of the concave portions.

BRIEF DESCRIPTION OF THE DRAWINGS

Exemplary embodiments of the present invention will be described in detail based on the following figures, wherein.

DETAILED DESCRIPTION

In what follows, an exemplary embodiment of the present invention will be described with reference to the drawings. A member having same operation or function is represented by same reference mark through all drawings and a duplicated explanation will be omitted.

[Tubular Body]

(Endless Belt)

As one example of a tubular body according to the exemplary embodiment, an endless belt will be described.

Figure 1:
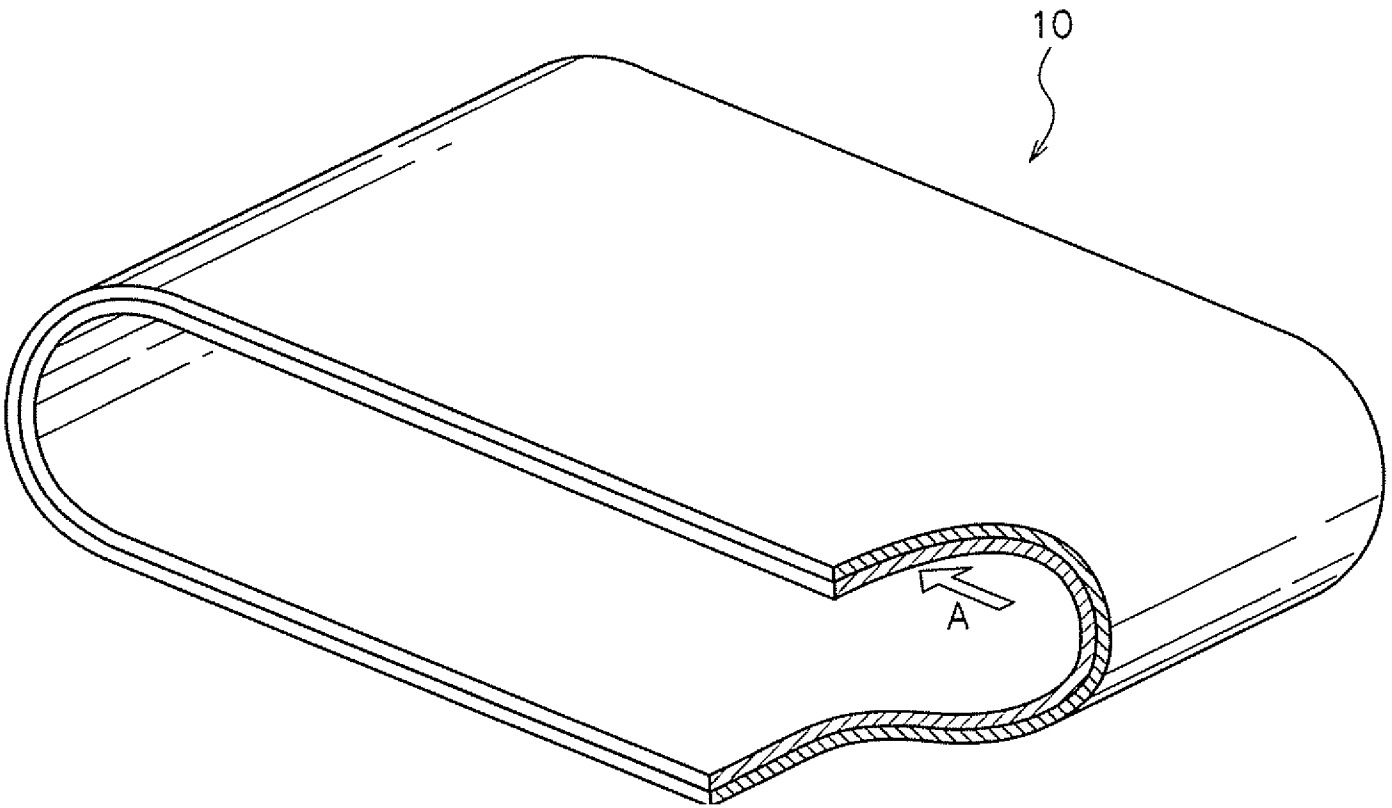
FIG. 1 is a perspective view showing one example of an endless belt according to the exemplary embodiment, a part being represented by a cross section.
Figure 2:
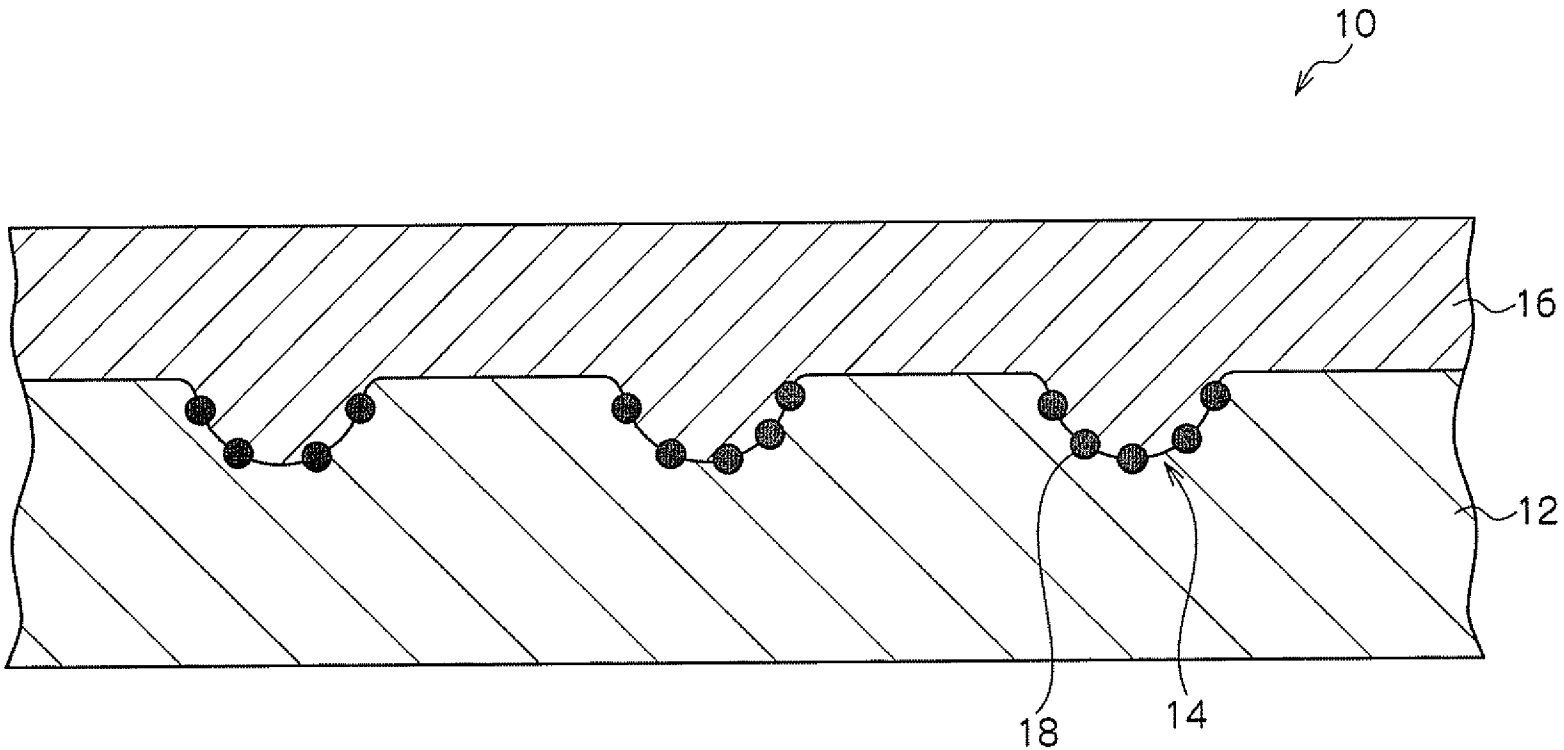
FIG. 2 is a sectional view of the endless belt seen from a direction of an arrow mark A in FIG. 1.
Figure 3:
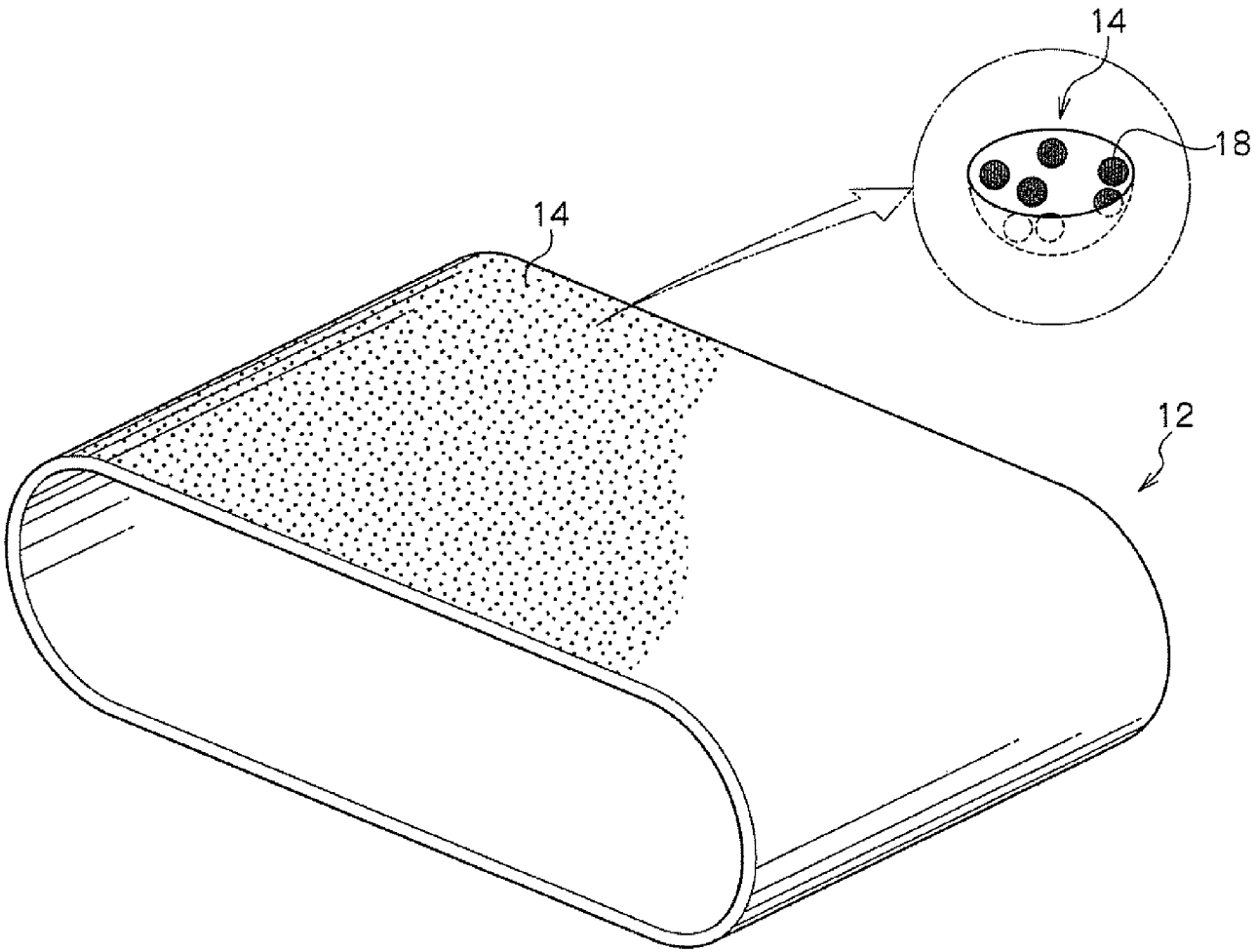
FIG. 3 is a perspective view showing a state where a surface layer is removed from an endless belt of the exemplary embodiment.
Figure 4:
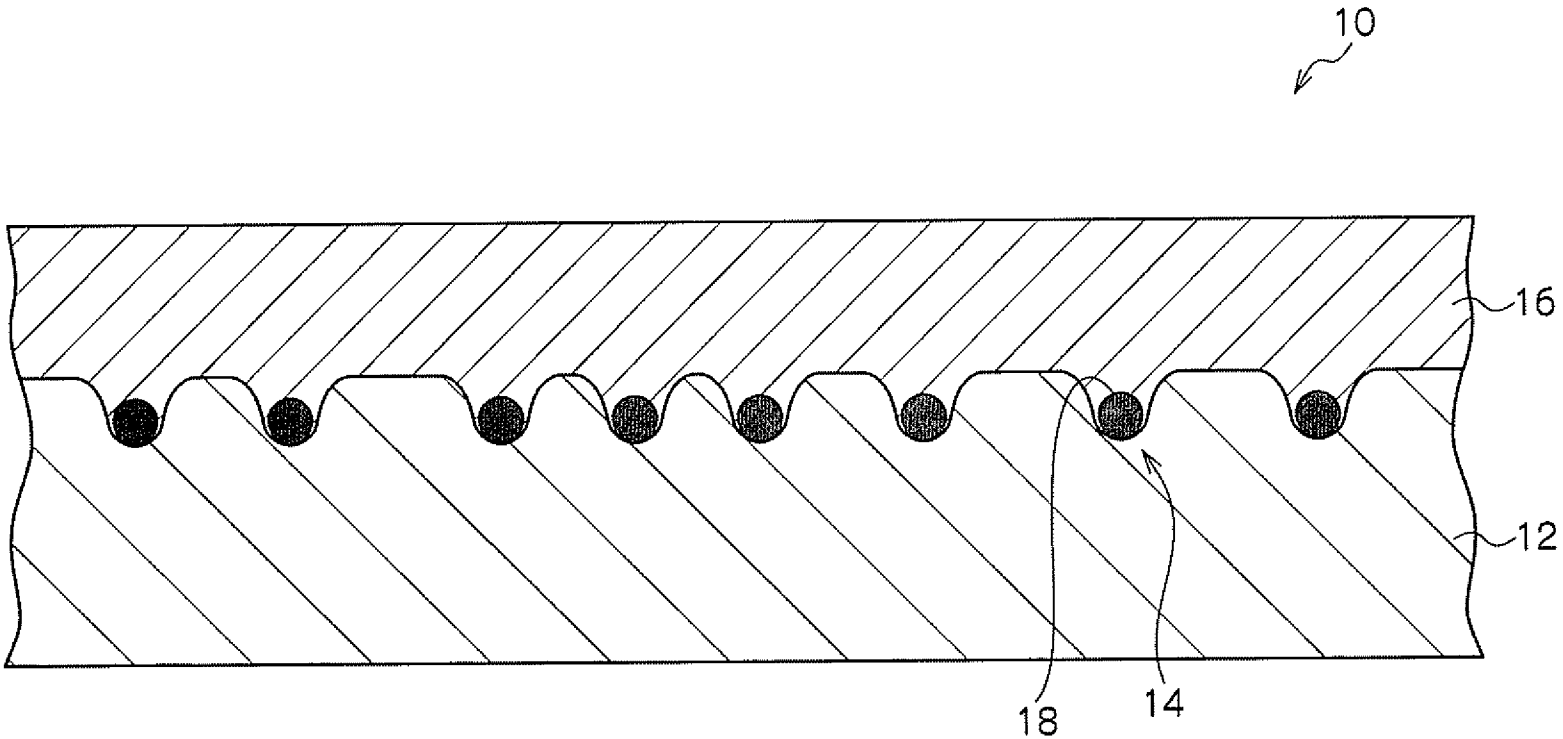
FIG. 4 is a sectional view showing another example of an endless belt of the exemplary embodiment.

FIG. 1 is a perspective view showing one example of an endless belt according to the exemplary embodiment (a part is represented by a cross section), and FIG. 2 is a sectional view of the endless belt seen from a direction of an arrow mark A in FIG. 1. Furthermore, FIG. 3 is a perspective view showing a state where a surface layer is removed from an endless belt of the exemplary embodiment. Still furthermore, FIG. 4 is a sectional view showing another example of an endless belt of the exemplary embodiment.

An endless belt 10 of the exemplary embodiment shown in FIG. 1 is, as shown in FIG. 2, an endless belt that has a substrate 12 having concave portions 14 on a surface, a surface layer 16 formed on the surface of the substrate 12 on the side thereof having the concave portions 14, and particles 18 positioned at an interface between the substrate 12 and the surface layer 16 in the concave portions 14.

In the endless belt 10, as shown in FIG. 3, plural concave portions 14 are formed on a surface (surface in contact with the surface layer 16) of the substrate 12 and, on an inside surface of each of the concave portions 14, plural particles 18 are present in a state of being embedded. The surface layer 16 formed on a surface of the substrate 12 is formed, as shown in FIG. 2, so as to cover a surface of the substrate 12 and the particles 18 and fill the inside of each of the concave portions 14. Accordingly, the particles 18 are present inside of each of the concave portions 14 of the substrate 12 and in a state in contact with both of the substrate 12 and the surface layer 16 (that is, positioned at an interface between the substrate 12 and the surface layer 16).

In the endless belt 10 of the exemplary embodiment, the concave portions 14 are present on a surface of the substrate 12, and the particles 18 are positioned at an interface between the substrate 12 and the surface layer 16 in each of the concave portions 14 on a surface of the substrate 12. Accordingly, owing to presence of the concave portions 14, an area of an interface between the substrate 12 and the surface layer 16 increases to be able to obtain an anchoring effect, and, owing to presence of the particles 18 on the inside surface of each of the concave portions 14, a surface area of the substrate 12 and the surface layer 16 further increases to enable to obtain a higher anchoring effect. As the result, adhesiveness between the substrate 12 and the surface layer 16 is improved to result in difficulty in peeling the surface layer 16 of the endless belt 10.

An average diameter of the concave portions 14 on a surface of the substrate 12 may be from 0.01 μm to 1,000 μm (or about 0.01 μm to about 1,000 μm), from 0.05 μm to 100 μm, or from 0.1 μm to 50 μm, from the viewpoint of improving adhesiveness between the substrate 12 and the surface layer 16. An average depth of the concave portions 14 may be from 0.01 μm to 500 μm, from 0.05 μm to 250 μm, or from 0.1 μm to 100 μm.

An average diameter and an average depth of the concave portions 14 are measured as shown below. Specifically, a cross section of the endless belt is cut out with a microtome, followed by observing the cross section with an electron microscope. Plural positions are observed and evaluated and thereby an average diameter and an average depth of the concave portions 14 are calculated.

Examples of a shape of the concave portion 14 include, for example, a hemisphere, a cylinder and an ellipse without particular restriction. However, a hemisphere or a cylinder may be selected from the viewpoint of developing an anchoring effect.

A number of the concave portions 14 present on a surface of the substrate 12 may be, per 1 $mm^2$ of an area of the surface of the substrate 12, from 1 to 1,000 (or from about 1 to about 1,000), from 5 to 500, or from 10 to 100.

Surface roughness Ra of a surface of the substrate 12 that has plural concave portions 14 may be from 0.01 μm to 20 μm, from 0.05 μm to 10 μm, or from 0.1 μm to 5 μm.

The surface roughness of the substrate 12 is obtained by measuring a surface of the substrate 12, using a measurement sample obtained by sticking a sample piece of the substrate 12 to a flat glass substrate, by use of a surface roughness meter SURFCOM 570A (trade name, manufactured by Tosei Engineering Corp.). Examples of measurement condition include, for example, shape of stylus tip: θ=90° conical stylus, diameter of stylus tip: tip r (tip)=2 μm, and a scanning length: 10.0 mm.

When a surface of the substrate 12 in the endless belt 10 is observed and measured, an exposed surface of the substrate 12 obtained by removing a surface layer 16 from the endless belt 10 as shown below is observed and measured. Specifically, a belt end is gently scraped with a plastic chip to remove a surface layer to expose a surface of the substrate 12.

A volume average particle diameter of the particles 18 may be from 0.01 μm to 15 μm (or from about 0.01 μm to about 15 μm), from 0.05 μm to 10 μm, or from 0.1 μm to 8 μm, from the viewpoint of improving adhesiveness between the substrate 12 and the surface layer 16.

A volume average particle diameter of the particles 18 is measured and defined as shown below. That is, MULTISIZER II (trade name, manufactured by Beckmann-Coulter Inc., aperture diameter: 50 μm) is used for measurement, a particle size distribution of measured particles is drawn as a cumulative distribution of a volume of the respective particles with respect to divided particle size ranges (channels) from a smaller particle size side, and a particle size where the cumulation becomes 50% is defined as a volume average particle diameter.

When a volume average particle diameter of the particles 18 is 15 μm or less, flatness of a surface of the endless belt 10 (that is, a surface of the surface layer 16 that is not in contact with the substrate 12) is inhibited from deteriorating owing to the particles 18. Furthermore, when a process of producing an endless belt 10 includes a step of spraying water in which the particles 18 are dispersed, since the volume average particle diameter of the particles 18 is 15 μm or less, the particles 18 are difficult to sediment in water; accordingly, a spray nozzle is difficult to being clogged during spraying. Furthermore, when the volume average particle diameter of the particles 18 is 0.01 μm or more, the particles 18 are inhibited from forming aggregated particles in water owing to too large surface area of the particles 18.

An average diameter of the concave portions 14 may be from 1 to 10,000 times (or from about 1 to about 10,000 times), from 2 to 1,000 times, or from 5 to 500 times the volume average particle diameter of the particles 18.

Examples of shape of the particles 18 include, for example, a sphere, an infinite form, a flake, a whisker, and a porous shape, without particularly restricting. Among these, when a shape of the particles 18 is a flake, a whisker or a porous shape, an increase in a surface area of the particles 18 causes an increase in a contact area with the substrate 12 or the surface layer 16, or charges tend to stay at apexes of the particles 18 to increase an electrostatic bonding action.

A number of particles 18 present at an inner surface of each of the concave portions 14 may be from 1 to 10,000 (or from about 1 to about 10,000), from 2 to 1,000, or from 5 to 500.

When the particles 18 are present at an inner surface of the concave portion 14, the particles 18 may be present at a position other than the concave portion 14 on a surface of the substrate 12.

A material of the particles 18 may be an inorganic compound or an organic compound without particularly restricting.

Examples of the inorganic compound include, for example, barium sulfate, zeolite, silicon oxide, tin oxide, copper oxide, iron oxide, zirconium oxide, titanium oxide, aluminum oxide, zinc oxide, nickel oxide, tin-doped indium oxide, silicon nitride, boron nitride, titanium nitride and silicon carbide.

As the organic compound, for example, a fluororesin is exemplified. Examples of the fluororesin include, for example, a tetrafluoroethylene polymer (hereinafter, referred to as PTFE), a tetrafluoroethylene/perfluoroalkyl vinyl ether copolymer (hereinafter, referred to as PFA), a tetrafluoroethylene/hexafluoropropylene copolymer (hereinafter, referred to as FEP), a tetrafluoroethylene/ethylene copolymer (hereinafter, referred to as ETFE), polyvinylidene fluoride (hereinafter, referred to as PVDF), polychlorotrifluoroethylene (hereinafter, referred to as PCTFE) and mixtures thereof. More specific examples of the fluororesin include PTFE, PFA, FEP and mixtures thereof from the viewpoint of more excellent heat resistance.

A material of the particles 18 may be a material high in affinity with a material of the surface layer 16 from the viewpoint of an improvement in adhesiveness between the substrate 12 and the surface layer 16. For example, when a fluororesin is used as a material of the surface layer 16, a material of the particles 18 may also be a fluororesin.

In the endless belt 10 of the exemplary embodiment, the particles 18 are in a state of being embedded in the inner surface of the concave portion 14. However, without restricting thereto, the particles 18 may be in a state of being in contact with an inner surface of the concave portion 14.

Furthermore, the endless belt 10 of the exemplary embodiment has plural particles 18 in each of the concave portions 14. However, without restricting thereto, like an endless belt 10 shown in FIG. 4, one particle 18 may be in each of the concave portions 14. However, an endless belt 10 may have plural particles 18 in each of concave portions 14 because a surface area in which a surface layer 16 is in contact with a substrate 12 and particles 18 is larger to result in larger adhesiveness between the substrate 12 and the surface layer 16 and to prevent the surface layer 16 from being peeled.

In what follows, the respective members constituting an endless belt 10 will be described.

<Substrate 12>

When an endless belt 10 is used as a fixing belt of an image fixing apparatus, as a material used for the substrate 12, a heat resistant material may be used and, specifically, selected and used from known various plastic and metal materials.

Among the plastic materials, plastic materials generally called an engineering plastic may be used. Examples thereof include, for example, a fluororesin, polyimide (PI), polyamideimide (PAI), polybenzimidazole (PBI), polyether ether ketone (PEEK), polysulfone (PSU), polyether sulfone (PES), polyphenylene sulfide (PPS), polyetherimide (PEI), and wholly aromatic polyesters (liquid crystal polymers). Among these, thermosetting polyimide, thermoplastic polyimide, polyamideimide, polyetherimide and a fluororesin may be used from the viewpoint of excellent mechanical strength, heat resistance, wear resistance and chemical resistance.

A metallic material is not particularly restricted. Various metals and alloys may be used. Specific examples thereof include, for example, SUS, nickel, copper, aluminum and iron. Furthermore, the heat resistant resin or the metallic material may be plurally layered.

When an endless belt 10 is used as a fixing belt of an image fixing apparatus, a thickness of a substrate 12 is, for example, in the range of from 50 μm to 150 μm.

Meanwhile, when an endless belt 10 is used as an intermediate transfer belt or a recording medium conveying belt of an image forming apparatus, examples of material used in the substrate 12 include, for example, a polyimide resin, a polyamideimide resin, a polyester resin, a polyamide resin and a fluororesin, among these a polyimide resin or a polyamideimide resin may be used. The substrate 12 may be formed into a seamless form or a form with seam as long as it is formed into a ring (endless) form. A thickness of the substrate 12 may be in a range of, for example, from 20 μm to 200 μm.

<Surface Layer 16>

As a material used in the surface layer 16, for example, a fluororesin is exemplified. A fluororesin material has flame resistance; accordingly, it may be used as a material of the surface layer 16.

Specific examples of the fluororesin material include, for example, a powder paint or resin tube of a fluororesin, a fluorine-modified urethane and silicone resin, a copolymerized fluororubber, fluororesin-copolymerized vinyl ether, PFA (tetrafluoroethylene perfluoroalkoxy resin) or FEP (tetrafluoroethylene/hexafluoropropylene copolymer paint), PTFE (tetrafluoroethylene) paint, PTFE-dispersed urethane paint, ETFE (polytetrafluoroethylene) tube, PVdF (polyvinylidene fluoride), and a PHV (polytetrafluoro vinylidene) resin material.

Furthermore, in the case where the endless belt 10 is used as an intermediate transfer belt, when a fluororesin material having volume resistivity larger than $10^{13}$ Ω·cm is used as a material of a surface layer 16, the surface layer 16 works as a surface insulating layer; accordingly, there is no need of separately disposing a surface insulating layer or a back conductive layer.

The surface layer 16 may have a heat resistant property. Specifically, a glass transition temperature of the surface layer 16 may be from 100° C. to 200° C. When the glass transition temperature of the surface layer 16 is set in the above range, for example, like the case where the endless belt 10 is used as a fixing belt, even when a step of heating the endless belt 10 is included, the endless belt 10 may be inhibited from deforming or being contaminated.

The glass transition temperature of the surface layer 16 is measured with a differential scanning calorimeter (trade name: DSC-50, manufactured by Shimadzu Corporation) based on JIS 7121-1987. When a temperature of a detector of the unit is calibrated, a melting temperature of a mixture of indium and Zn is used and an amount of heat is calibrated with heat of fusion of indium. A sample is put in an aluminum pan, the aluminum pan which a sample is put in and a vacant aluminum pan for reference are set, and a measurement is conducted at a temperature rising rate of 10° C./min. A temperature at a point of an intersection of extrapolated lines of a base line in an endothermic portion and a rising line of a DSC curve obtained by the measurement is referred to as a glass transition temperature.

A thickness of the surface layer 16 is, for example, from 5 μm to 400 μm.

<Characteristics of Endless Belt 10>

When an endless belt 10 is used as an intermediate transfer belt or a recording medium conveying belt, surface resistivity may be controlled in the range of from $1\times10^{9}$Ω/□ to $1\times10^{14}$Ω/□ and volume resistivity may be controlled in the range of from $1\times10^{8}$ Ωcm to $1\times10^{13}$ Ωcm. In this connection, as required, to the substrate 12 or the surface layer 16, as a conductive agent, carbon black such as Ketjen black or acetylene black, graphite, metal or alloy such as aluminum, nickel or a copper alloy, metal oxide such as tin oxide, zinc oxide, potassium titanate, tin oxide-indium oxide or tin oxide-antimony oxide composite oxide, or a conductive polymer such as polyaniline, polypyrrole, polysulfone or polyacetylene may be added (herein, "conductive" in the polymer means that volume resistivity is less than $10^{7}$ Ω·cm). The conductive agents may be added singularly or in a combination of at least two thereof. Furthermore, in order to control the surface resistivity or volume resistivity, the conductive agent may be added to the particles 18 or particles of the conductive agent themselves may be used as the particles 18.

Herein, the surface resistivity and volume resistivity are measured by use of HIRESTA UPMCP-450 model UR Probe (trade name, manufactured by Dia Instrument Co., Ltd.) under an environment of 22° C. and 55% RH, in compliance with JIS-K 6911.

<Method for Producing Endless Belt 10>

In what follows, as an example of a method for producing an endless belt 10, a method for producing an endless belt 10 that uses a polyimide resin as a material of the substrate 12 will be described. However, as mentioned above, a material of the substrate 12 of the endless belt 10 is not restricted to a polyimide resin.

—Step of Preparing Polyamide Acid Solution—

A polyimide resin used as a material of the substrate 12 is produced by heating a solution of polyamide acid (that is, polyimide precursor) to imidize. In this connection, in a production of an endless belt 10 that uses a polyimide resin as a material of the substrate 12, in the beginning, a polyamide acid solution is prepared (step of preparing polyamide acid solution).

Polyamide acid is synthesized in a solvent with a diamine compound and tetracarboxylic dianhydride.

As tetracarboxylic dianhydride, aromatic compounds and aliphatic compounds are exemplified. However, without particular restriction, any one thereof may be used.

Examples of the aromatic tetracarboxylic dianhydride include, for example, pyromellitic dianhydride, 3,3',4,4'-benzophenonetetracarboxylic dianhydride, 3,3',4,4'-biphenylsulfonetetracarboxylic dianhydride, 1,4,5,8-naphthalenetetracarboxylic dianhydride, 2,3,6,7-naphthalenetetracarboxylic dianhydride, 3,3',4,4'-biphenylethertetracarboxylic dianhydride, 3,3',4,4'-dimethyldiphenylsilanetetracarboxylic dianhydride, 3,3',4,4'-tetraphenylsilanetetracarboxylic dianhydride, 1,2,3,4-furantetracarboxylic dianhydride, 4,4'-bis(3,4-dicarboxyphenoxy)diphenylsulfide dianhydride, 4,4'-bis(3,4-dicarboxyphenoxy)diphenylsulfone dianhydride, 4,4'-bis(3,4-dicarboxyphenoxy)diphenylpropane dianhydride, 3,3'4,4'-perfluoroisopropylidenediphthalic dianhydride, 3,3',4,4'-biphenyl tetracarboxylic dianhydride, bis(phthalic acid) phenylphosphineoxide dianhydride, p-phenylene-bis(triphenylphthalic acid) dianhydride, m-phenylene-bis(triphenylphthalic acid) dianhydride, bis(triphenylphthalic acid)-4,4'-diphenylether dianhydride, and bis(triphenylphthalic acid)-4,4'-diphenylmethane dianhydride.

Examples of the aliphatic tetracarboxylic dianhydride include, for example, aliphatic or alicyclic tetracarboxylic dianhydride such as butanetetracarboxylic dianhydride, 1,2,3,4-cyclobutanetetracarboxylic dianhydride, 1,3-dimethyl-1,2,3,4-cyclobutanetetracarboxylic acid, 1,2,3,4-cyclopentanetetracarboxylic dianhydride, 2,3,5-tricarboxycyciopentylacetic dianhydride, 3,5,6-tricarboxynorbornane-2-acetic dianhydride, 2,3,4,5-tetrahydrofurantetracarboxylic dianhydride, 5-(2,5-dioxotetrahydrofuranyl)-3-methyl-3-cyclohexene-1,2-dicarboxylic dianhydride, or bicyclo[2,2,2]-oct-7-ene-2,3,5,6-tetracarboxylic dianhydride; and aromatic ring-containing aliphatic tetracarboxylic dianhydride such as 1,3,3a,4,5,9b-hexahydro-2,5-dioxo-3-furanyl)-naphtho[1,2-c]furan-1,3-dione, 1,3,3a,4,5,9b-hexahydro-5-methyl-5-(tetrahydro-2,5-dioxo-3-furanyl)-naphtho[1,2-c]furan-1,3-dione, or 1,3,3a,4,5,9b-hexahydro-8-methyl-5-(tetrahydro-2,5-dioxo-3-furanyl)-naphtho[1,2-c]furan-1,3-dione.

The tetracarboxylic dianhydride may be, among the compounds, an aromatic tetracarboxylic dianhydride, and specifically pyromellitic dianhydride, 3,3',4,4'-benzophenonetetracarboxylic dianhydride or 3,3',4,4'-biphenylsulfonetetracarboxylic dianhydride. The tetracarboxylic dianhydrides may be used singularly or in a combination of at least two thereof.

The diamine compound is not particularly restricted as long as it is a diamine compound having two amino groups in its molecular structure. Examples thereof include, for example, aromatic diamines such as p-phenylenediamine, m-phenylenediamine, 4,4'-diaminodiphenylmethane, 4,4'-diaminodiphenylethane, 4,4'-diaminodiphenylether, 4,4'-diaminodiphenylsulfide, 4,4'-diaminodiphenylsulfone, 1,5-diaminonaphthalene, 3,3-dimethyl-4,4'-diaminobiphenyl, 5-amino-1-(4'-aminophenyl)-1,3,3-trimethylindane, 6-amino-1-(4'-aminophenyl)-1,3,3-trimethylindane, 4,4'-diaminobenzanilide, 3,5-diamino-3'-trifluoromethylbenzanilide, 3,5-diamino-4'-trifluoromethylbenzanilide, 3,4'-diaminodiphenylether, 2,7-diaminofluorene, 2,2-bis(4-aminophenyl)hexafluoropropane, 4,4'-methylene-bis(2-chloroaniline), 2,2',5,5'-tetrachloro-4,4'-diaminobiphenyl, 2,2'-dichloro-4,4'-diamino-5,5'-dimethoxybiphenyl, 3,3'-dimethoxy-4,4'-diaminobiphenyl, 4,4'-diamino-2,2'-bis(trifluoromethyl)biphenyl, 2,2-bis[4-(4-aminophenoxy)phenyl]propane, 2,2-bis[4-(4-aminophenoxy)phenyl]hexafluoropropane, 1,4-bis(4-aminophenoxy)benzene, 4,4'-bis(4-aminophenoxy)-biphenyl, 1,3'-bis(4-aminophenoxy)benzene, 9,9-bis(4-aminophenyl)fluorene, 4,4'-(p-phenylene isopropylidene)bisaniline, 4,4'-(m-phenylene isopropylidene)bisaniline, 2,2'-bis[4-(4-amino-2-trifluoromethylphenoxy)phenyl]hexafluoropropane, and 4,4'-bis[4-(4-amino-2-trifluoromethyl)phenoxy]-octafluorobiphenyl; aromatic diamines having two amino groups bound to an aromatic ring and a heteroatom other than the nitrogen atoms of the amino groups such as diaminotetraphenylthiophene; and aliphatic diamines and alicyclic diamines such as 1,1-meta xylylenediamine, 1,3-propanediamine, tetramethylenediamine, pentamethylenediamine, octamethylenediamine, nonamethylenediamine, 4,4-diaminoheptamethylenediamine, 1,4-diaminocyclohexane, isophoronediamine, tetrahydrodicyciopentadienylenediamine, hexahydro-4,7-methanoindanylenedimethylenediamine, tricyclo[6,2,1,02.7]-undecylenedimethyidiamine, and 4,4'-methylenebis(cyclohexylamine).

The diamine compound may be p-phenylenediamine, 4,4'-diaminodiphenylmethane, 4,4'-diaminodiphenylether, 4,4'-diaminodiphenylsulfide, or 4,4'-diaminodiphenylsulfone among these compounds. These diamine compounds may be used singularly or in a combination of at least two thereof.

Polyamide acid may be polyamide acid synthesized by use of aromatic tetracarboxylic dianhydride and aromatic diamine from the viewpoint of the mechanical strength of a compact (polyimide resin substrate).

As a solvent used for synthesizing polyamide acid, for example, an organic polar solvent may be used. Examples of organic polar solvent include, for example, a sulfoxide solvent such as dimethylsulfoxide or diethylsulfoxide, a formamide solvent such as N,N-dimethylformamide or N,N-diethylformamide, an acetamide solvent such as N,N-dimethylacetamide or N,N-diethylacetamide, a pyrrolidone solvent such as N-methyl-2-pyrrolidone or N-vinyl-2-pyrrolidone, a phenol solvent such as phenol, o-, m-, or p-cresol, xylenol, halogenated phenol or catechol, an ether solvent such as tetrahydrofuran, dioxane or dioxolane, an alcohol solvent such as methanol, ethanol or butanol, a cellosolve solvent such as butyl cellosolve, hexamethylphosphoramide, and γ-butylolactone. These may be used singularly or in a combination thereof.

As a solvent used for synthesizing polyamide acid, other than the organic polar solvents, an aromatic hydrocarbon such as xylene or toluene may be used.

A solvent used for synthesizing polyamide acid may be capable of dissolving synthesized polyamide acid and partially imidized polyamide acid.

A polyamide acid solution may contain a solvent so that a solid content therein may be from 5% by weight to 30% by weight.

—First Coating Liquid Film Forming Step—

In a first coating liquid film forming step, a polyamide acid solution prepared in the step of preparing a polyamide acid solution is coated on an outer peripheral surface of a cylindrical core body to form a first coating liquid film (that is, a coating liquid film of a polyamide acid solution).

A method for coating a polyamide acid solution on an outer peripheral surface of a cylindrical core body is selected depending on a situation without restricting to particular one. Examples of specific coating method include, for example, a method where the cylindrical core body is dipped in a polyamide acid solution and pulled up to coat on an outer peripheral surface of the cylindrical core body and a method where a solution is ejected onto a surface of the cylindrical core body with the cylindrical core body rotating in a horizontal direction with respect to a center axis thereof to spirally coat, followed by smoothing a coating liquid film of polyamide acid solution with a blade.

As a material of the cylindrical core body, a metal such as aluminum, nickel, or stainless steel may be used. Among these, aluminum may be used from the viewpoint of large thermal expansion coefficient.

A surface of the cylindrical core body may be plated with chromium or nickel or may be coated with a fluororesin or a silicone resin.

A surface of the cylindrical core body may be roughened to have a surface roughness Ra of from 0.2 μm to 2 μm. Examples of a method for roughening a surface specifically include, for example, a blasting method, a grinding method and a sand paper treatment. As a method for roughening a surface, among the foregoing methods, a method where a blasting treatment is applied on a surface of a cylindrical core body with spherical particles may be used from the viewpoint of putting an inner surface of a polyimide resin endless belt into a state of a spherical surface having high slidability and a state where a projected fine unevenness is formed.

—Drying Step—

In a drying step, a coating liquid film of a polyamide acid solution formed on an outer peripheral surface of a cylindrical core body in the first coating liquid film forming step is dried to form a coating film. Specifically, a coating liquid film of a polyamide acid solution is dried at a temperature in the range of from 40° C. to 130° C. At this time, a coating liquid film of a polyamide acid solution tends to cause sagging owing to gravity. In this connection, in order to inhibit a polyamide acid solution from sagging, a cylindrical core body on which a coating liquid film of a polyamide acid solution is coated may be kept horizontal in an axial direction while being rotated at a speed in the range of from 10 rpm to 60 rpm to dry. Also in the first coating liquid film forming step, a polyamide acid solution may be coated while rotating, followed by, while continuing rotating, conducting the step of drying.

—Step of Applying Liquid Droplets—

In a step of applying liquid droplets, liquid droplets containing an aqueous solvent are applied to a coating liquid film of a polyamide acid solution formed in the first coating liquid film forming step or to a coating film formed by drying a coating liquid film of a polyamide acid solution in the step of drying. That is, a step of applying liquid droplets is conducted after the first coating liquid film forming step but before the drying step, or after the drying step.

When the liquid droplet applying step is conducted, concave portions 14 are formed on a surface of the substrate 12. Specifically, when a liquid droplets come into contact with a first coating liquid film or a coating film, at a contact portion, a mixing reaction or a substitution reaction between a solvent contained in the first coating liquid film or coating film (an organic polar solvent, in particular) and an aqueous solvent contained in the liquid droplets is caused to generate a mixed solution. That is, at the contact portion, a solvent in the first coating liquid film or coating film moves into liquid droplets, thereby an amount of a solvent contained in the first coating liquid film or coating film is reduced and the liquid droplets become a mixed solution of the aqueous solvent and the solvent. On the other hand, polyamide acid is dissolved with difficulty in the mixed solution; accordingly, in the first coating liquid film or coating film, which contains polyamide acid, a concentration of a solid content increases and a volume decreases. As the result, concave portions are formed in the first coating liquid film or coating film in the contact portion to roughen the first coating liquid film or coating film.

In the liquid droplet applying step, when liquid droplets heated at from 40° C. to 100° C. are applied to the first coating liquid film or coating film, solubility of the solvent to an aqueous solvent increases; accordingly, the mixing reaction and the substitution reaction are forwarded. As the result, an amount of volume reduction of the first coating liquid film or the coating film at a contact portion of the liquid droplet becomes larger to intensify a surface roughening effect.

The liquid droplet applying step, as mentioned above, may be applied either before the drying step or after the drying step. However, the liquid droplet applying step is necessarily applied in a state where the solvent is contained in at least the first coating liquid film or the coating film.

When the liquid droplet applying step is conducted, an amount of the solvent contained in the first coating liquid film or the coating film (a remaining amount of the solvent) is in the range of, for example, from 20% to 90%. The remaining amount of the solvent is measured as shown below. Specifically, a weight of the coating liquid film is measured from an increment of total weights before and after coating, a weight of the belt after baking of the coating liquid film is measured, and a ratio of a weight of a baked belt to a weight of the coating liquid film is calculated.

After the liquid droplet applying step, depending on circumstances, a drying step may be further applied. The liquid droplet applying step may be carried out both of before and after the drying step from the viewpoint of obtaining higher surface roughening effect.

A method for applying liquid droplets is not particularly restricted. Specifically, it is possible to use a sprayer that sprays a liquid in particle such as a nebulizer or a sprayer to spray liquid droplets onto the first coating liquid film or the coating film. Furthermore, as a liquid droplet applying method other than the spraying, for example, a method where inkjet is used to apply liquid droplets is exemplified.

The liquid droplets contain at least an aqueous solvent and, as required, may contain other components. Examples of the aqueous solvent include, for example, water such as distilled water or ion exchanged water, and alcohols, among these, water may be used. These may be used singularly or in a combination of at least two thereof. As another component, for example, a surfactant is exemplified.

The liquid droplets may contain the particles 18. When liquid droplets containing an aqueous solvent and the particles 18 are applied to the first coating liquid film or the coating film in the liquid droplet applying step, adhesiveness between the substrate 12 and the surface layer 16 is made more excellent.

Specifically, when, for example, a particle dispersion liquid obtained by mixing the particles 18 in water is sprayed to the first coating liquid film or the coating film, the particle dispersion liquid comes into contact with the first coating liquid film or the coating film. At this time, in the contact portion, water attached to a surface of the particles 18 causes a mixing reaction or substitution reaction with a solvent contained in the first coating liquid film or the coating film. Accordingly, the particles 18 move toward an inner surface of a concave portion generated at the contact portion. Furthermore, owing to a thixotropic property of a polyamide acid solution in the first coating liquid film or the coating film, a part of the particles 18 intrude into the first coating liquid film or the coating film.

Then, for example, when, in this state, a coating step described below is conducted, followed by a heating step described below, the particles 18 are positioned at an interface between the substrate 12 and the surface layer 16 and strongly bond with both the substrate 12 and the surface layer 16. That is, in the heating step, when polyamide acid is imidized to generate a polyimide resin and a surface layer forming material is baked to form a surface layer, an effect that the polyimide resin of the substrate 12 and the surface layer 16 are contracted by heating to strongly clip the particles 18 is obtained. Furthermore, since the particles 18 are positioned at an interface between the substrate 12 and the surface layer 16, a contact area of the substrate 12, the surface layer 16 and the particles 18 becomes larger to result in an effect that a chemical bonding effect such as an electrostatic bonding action is generated more strongly.

On the other hand, in the case where liquid droplets that do not contain the particles 18 are used, as a method for producing an endless belt 10 having the particles 18 in the concave portion 14 of the substrate 12, a method where the particles 18 are applied to a surface of the first coating liquid film or the coating film after the liquid droplet applying step or a method where after the liquid droplet applying step, a heating step is conducted to produce the substrate 12 having the concave portions 14, followed by applying the particles 18 to the concave portions 14 of the substrate 12 is exemplified.

A droplet diameter of a liquid droplet may be from 0.01 μm to 1,000 μm, from 0.05 μm to 500 μm, or from 0.1 μm to 100 μm.

A droplet diameter of a liquid droplet is measured as shown below. Specifically, liquid droplets are applied on a surface of a coating liquid film, diameters of attached liquid droplets are observed with a microscope, and an image thereof is processed to measure an average value of liquid droplet diameters.

When a droplet diameter of a liquid droplet is 0.01 μm or more, in the case where a liquid droplet applying step is conducted with liquid droplets containing the particles 18, the particles 18 intrude inside of the first coating liquid film or the coating film, and the particles 18 intervene between the substrate 12 and the surface layer 16 to generate a bonding effect. On the other hand, when a diameter of a concave portion 14 is too large, an anchoring effect may decrease in some cases. However, when a droplet diameter of a liquid droplet is 1,000 μm or less, a diameter of the concave portion 14 is not excessively large; accordingly, because of the anchoring effect, adhesive strength between the substrate 12 and the surface layer 16 is increased.

—Heating Step (First Heating Step)—

In a heating step (first heating step), a first coating liquid film or a coating film to which liquid droplets are applied in the liquid droplet applying step is heated at a temperature from 200° C. to 450° C. to forward an imidization reaction of polyamide acid to obtain a polyimide resin. The heating step is conducted with the first coating liquid film or the coating film formed on a surface of a cylindrical core body. An imidization temperature (heating temperature) is different respectively depending on species of tetracarboxylic dianhydride and diamine, which are starting materials of a polyamic acid. However, it may be set at a temperature where the imidization reaction comes to completion.

—Second Coating Liquid Film Forming Step—

In a second coating liquid film forming step, on a surface of a first coating liquid film or a coating film on which liquid droplets are applied in the liquid droplet applying step or a polyimide resin obtained in the first heating step, a coating liquid containing a material for forming a surface layer 16 is coated to form a second coating liquid film. That is, the second coating liquid film forming step is applied after the liquid droplet applying step and may be conducted either before the first heating step or after the first heating step.

As a coating liquid used in the second coating liquid film forming step, for example, a dispersion liquid where a material that forms a surface layer 16 is dispersed in a solvent is exemplified. Specifically, for example, when a fluororesin is used as a material of the surface layer 16, as a coating liquid being used, for example, a solution where a fluororesin is dispersed in a solvent is exemplified.

As a solvent, for example, water is exemplified. Alcohol such as ethanol or butanol, glycol such as ethylene glycol, or esters thereof may be used together.

In the coating liquid, as required, a surfactant or a viscosity adjusting agent may be added. Furthermore, when a material such as carbon powder, titanium oxide or barium sulfate other than a fluororesin is contained in a surface layer 16, the material may be mixed and dispersed in the coating liquid.

As a method for coating a coating liquid (a method for forming a second coating liquid film), for example, a dipping method, a spray coating method and a ring coating method are exemplified.

As mentioned above, a second coating liquid film forming step may be conducted either before the first heating step or after the first heating step. However, a second coating liquid film forming step may be carried out before the first heating step from the viewpoint of improving adhesiveness between a substrate 12 and a surface layer 16. That is, a method for producing an endless belt 10 may include a step where the coating liquid is applied on a surface of a first coating liquid film or a coating film on which liquid droplets are applied in a liquid droplet applying step to form a second coating liquid film, and a step where the first coating liquid film or the coating film on which a second coating liquid film is formed and the second coating liquid film are heated.

When a second coating liquid film forming step is conducted before a first heating step where a first coating liquid film or a coating film is imidized, in a heating step after a second coating liquid film is formed, polyamide acid in a first coating liquid film or a coating film causes an imidization reaction and a resin contained in a second coating liquid film coated on a surface of a first coating liquid film or a coating film is baked. Since a first coating liquid film or a coating film and a second coating liquid film are contracted by heating, particles 18 are strongly gripped by a substrate 12 and a surface layer 16. Accordingly, compared with a case where a second coating liquid film forming step is conducted after a first heating step where a first coating liquid film or a coating film is imidized, when a second coating liquid film forming step is conducted before the first heating step, an endless belt 10 excellent in adhesiveness between a substrate 12 and a surface layer 16 is obtained. When a second coating liquid film forming step is conducted before the first heating step, a heating temperature in a heating step after a second coating liquid film forming step may be set at a temperature equal to or higher than a melting temperature of a material constituting a surface layer 16.

On the other hand, when a second coating liquid film forming step is conducted after the first heating step, a second heating step where a second coating liquid film is heated to form a surface layer 16 is necessary. In this case, a heating temperature in a second heating step, similarly to the first heating step, may also be from 200° C. to 450° C. and equal to or more than a melting temperature of a material constituting a surface layer 16.

When a second coating liquid film forming step is followed by a heating step and further followed by cooling to normal temperature (25° C.), a cylindrical core body on which a fluororesin and a polyimide resin are layered is obtained. When a cylindrical core body is removed therefrom, an endless belt 10 is produced. An endless belt 10 is, as required, cut to trim lengths of ends or ground to adjust surface roughness.

In what is mentioned above, a method for producing an endless belt 10, that is, a method for producing an endless belt 10 where particles 18 are positioned at an interface between a substrate 12 and a surface layer 16 in concave portions 14 of a substrate 12 is described. The foregoing method is effective as well in the case where an endless belt that does not contain a particle 18 is produced.

That is, also in the case where an endless belt that contains a substrate that has concave portions on a surface thereof and a surface layer formed on a surface of the substrate and does not contain a particle is produced, a method for producing, which contains the first coating liquid film forming step, a drying step, a liquid droplet applying step, a second coating liquid film forming step and a heating step, may be used. Specifically, in the liquid droplet applying step, when liquid droplets that contain an aqueous solvent and do not contain a particle is applied on a surface of a first coating liquid film or a coating film, concave portions are readily formed on a surface of a substrate. In particular, in the liquid droplet applying step, when the sprayer is used to spray, concave portions on a surface of a substrate are more readily formed.

(Other Form)

In what is mentioned above, as an example of a tubular body according to the present exemplary embodiment, an endless belt is described. However, a tubular body of the present exemplary embodiment may have another form without restricting to an endless belt. Specific examples of other form include, for example, a roll used as a charging roll, a transfer roll, a pressure roll, or a heating roil is exemplified.

Specifically, for example, a roll that includes a core having concave portions on a surface thereof, a peeling layer formed on a surface of the core and particles positioned at an interface between the core and the peeling layer in the concave portions is exemplified.

A material of a core is not particularly restricted and may be a material excellent in mechanical strength and excellent in heat conductivity. Specific examples of core material include, for example, metal such as aluminum, SUS, iron or copper, an alloy, ceramics and FRM (fiber-reinforced metal).

As a material of a peeling layer, for example, a fluororesin such as PFA may be used. In order to improve endurance and wear resistance, plural fluororesins may be contained.

A thickness of a peeling layer may be from 10 μm to 100 μm, or from 20 μm to 30 μm.

[Image Fixing Apparatus, Image Forming Apparatus, Tubular Body Supporting Apparatus]

First Exemplary Embodiment

Figure 5:
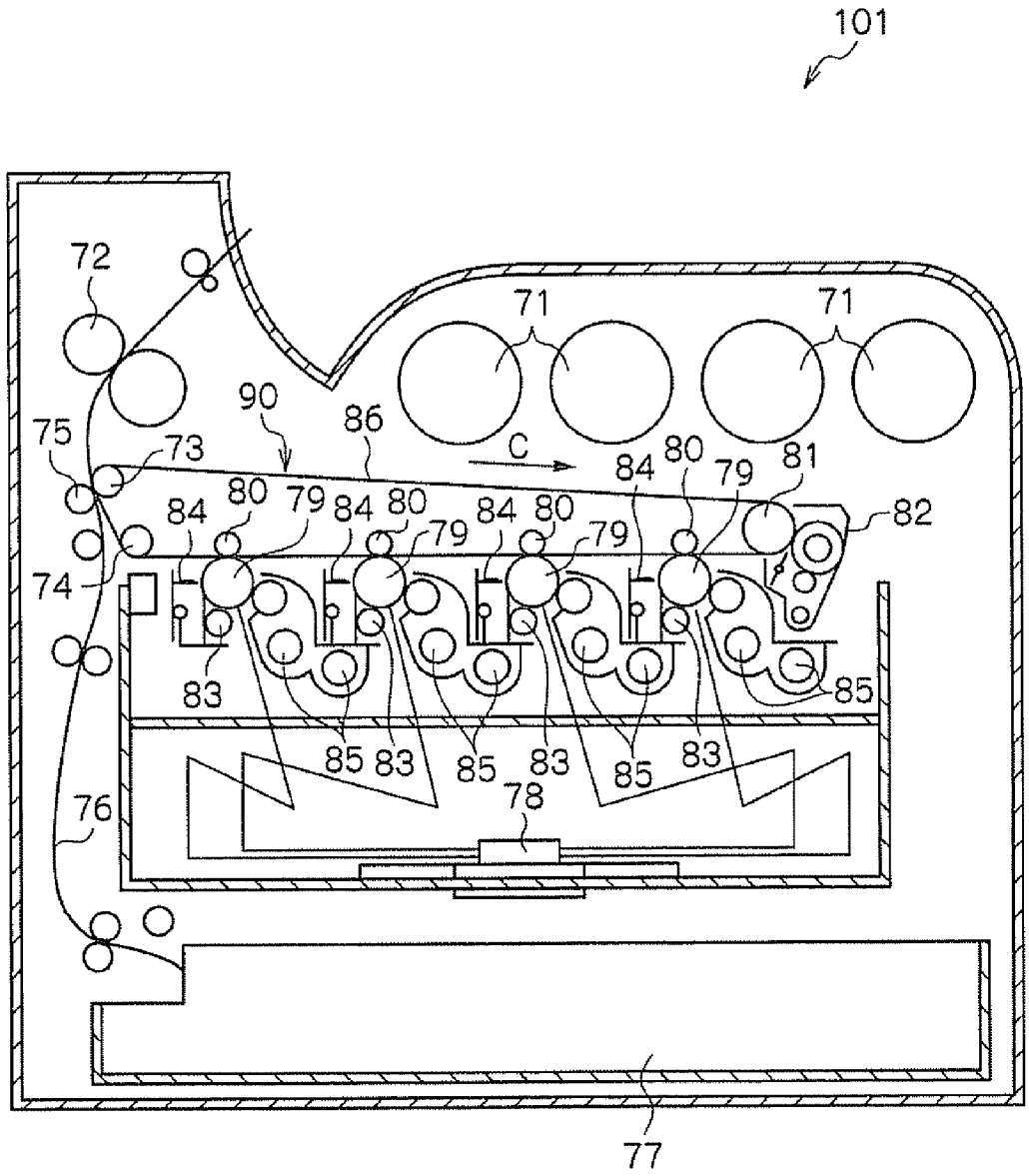
FIG. 5 is a schematic configurational view showing an image forming apparatus that uses an endless belt according to the exemplary embodiment.

In the next place, an image forming apparatus of a first exemplary embodiment that uses a tubular body of the exemplary embodiment will be described. FIG. 5 is a schematic diagram for explaining as main portion of a tandem image forming apparatus that includes an endless belt that is a tubular body according to the exemplary embodiment as a pressure belt of a fixing unit.

Specifically, an image forming apparatus 101 includes a photoreceptor 79 (electrostatic latent image holding member), a charging roll 83 for charging a surface of a photoreceptor 79, a laser generator 78 (electrostatic latent image forming unit) that exposes a surface of a photoreceptor 79 to form an electrostatic latent image, a developing unit 85 (developing unit) that develops a latent image formed on a surface of a photoreceptor 79 with a developer to form a toner image, an intermediate transfer belt 86 (intermediate transfer medium) to which a toner image formed by a developing unit 85 is transferred from a photoreceptor 79, a first transfer roll 80 (first transfer unit) that transfers a toner image to an intermediate transfer belt 86, a photoreceptor cleaning member 84 for removing a toner or dust attached to a photoreceptor 79, a second transfer roll 75 (second transfer unit) for transferring a toner image on an intermediate transfer belt 86 to a recording medium, and a fixing unit 72 (fixing unit) for fixing a toner image on a recording medium. A first transfer roll 80 may be disposed immediately above a photoreceptor 79 as shown in FIG. 5 or may be disposed at a position slightly displaced from immediate above a photoreceptor 79.

Furthermore, a configuration of an image forming apparatus 101 shown in FIG. 5 will be detailed.

In an image forming apparatus 101, a charging roll 83, a developing unit 85, a first transfer roll 80 disposed via an intermediate transfer belt 86, and a photoreceptor cleaning member 84 are disposed counterclockwise around a photoreceptor 79, and one set of the members forms a developing unit corresponding to one color. For every developing unit, a toner cartridge 71 that replenishes a developer to a developing unit 85 is disposed, and, for a photoreceptor 79 of each of the developing units, a laser generator 78 that illuminates laser light in accordance with image information on a surface of a photoreceptor 79 on a downstream side of a charging roll 83 (in a rotating direction of a photoreceptor 79) and on an upstream side of a developing unit 85 is disposed.

Four developing units corresponding to four colors (for example, cyan, magenta, yellow, and black) are disposed in series in a horizontal direction in an image forming apparatus 101, and an intermediate transfer belt 86 is disposed so as to go through transfer regions of photoreceptors 79 and first transfer rolls 80 of four developing units. An intermediate transfer belt 86 is bridged with a tension applied by a support roll 73, a support roll 74, and a drive roll 81, which are disposed on an inner surface side of the intermediate transfer belt 86 counterclockwise in an above-mentioned order, and forms a belt supporting unit 90. Four first transfer rolls are located on a downstream side of a support roll 73 (in a direction of rotation of an intermediate transfer belt 86) and on an upstream side of a support roll 74. Furthermore, on an opposite side of a driving roll 81 via an intermediate transfer belt 86, a transfer cleaning member 82 for cleaning an outer peripheral surface of an intermediate transfer belt 86 is disposed so as to come into contact with a driving roll 81 under pressure.

On an opposite side of a support roll 73 via an intermediate transfer belt 86, a second transfer roll 75 for transferring a toner image formed on an outer peripheral surface of an intermediate transfer belt 86 to a surface of a recording paper sheet transported from a paper feed portion 77 via a paper sheet path 76 is disposed so as to come into contact with a support roll 73.

At a bottom of an image forming apparatus 101, a paper sheet feed portion 77 for housing a recording medium is disposed, and a recording medium is fed so as to go through a contact portion of a support roll 73 and a second transfer roll 75, which form a second transfer portion, from a paper sheet feed portion 77 via a paper sheet path 76. A recording medium which have gone through the contact portion is further transported by a not shown conveying unit so as to go through a contact portion of a fixing unit 72 and finally ejected outside of an image forming apparatus 101.

In the next place, an image forming method that uses an image forming apparatus 101 shown in FIG. 5 will be described. A toner image is formed for every developing unit. After a surface of a photoreceptor 79 that rotates counterclockwise is charged by a charging roll 83, a latent image (electrostatic latent image) is formed on a surface of the charged photoreceptor 79 by a laser generator 78 (exposure unit), then, the latent image is developed with a developer fed from a developing unit 85 to form a toner image, and a toner image transported to a contact portion of a first transfer roll 80 and a photoreceptor 79 is transferred to an outer peripheral surface of an intermediate transfer belt 86 that rotates in a direction of an arrow mark C. A photoreceptor 79 from which a toner image is transferred is cleansed by a photoreceptor cleaning member 84 to remove a toner and dust attached on a surface thereof to prepare for forming a next toner image.

A toner image developed by every developing unit of each of colors, which is in a state of being sequentially superposed on an outer peripheral surface of an intermediate transfer belt 86 so as to correspond to image information, is transported to a second transfer portion, and transferred by a second transfer roll 75 to a surface of a recording paper sheet transported from a paper sheet feed portion 77 through a paper sheet path 76. A recording paper sheet on which a toner image is transferred is pressurized under heating to fix when going through a contact portion of a fixing unit 72 to form an image on a surface of a recording medium, followed by ejecting outside of an image forming apparatus.

—Fixing Unit (Image Fixing Apparatus)—

Figure 6:
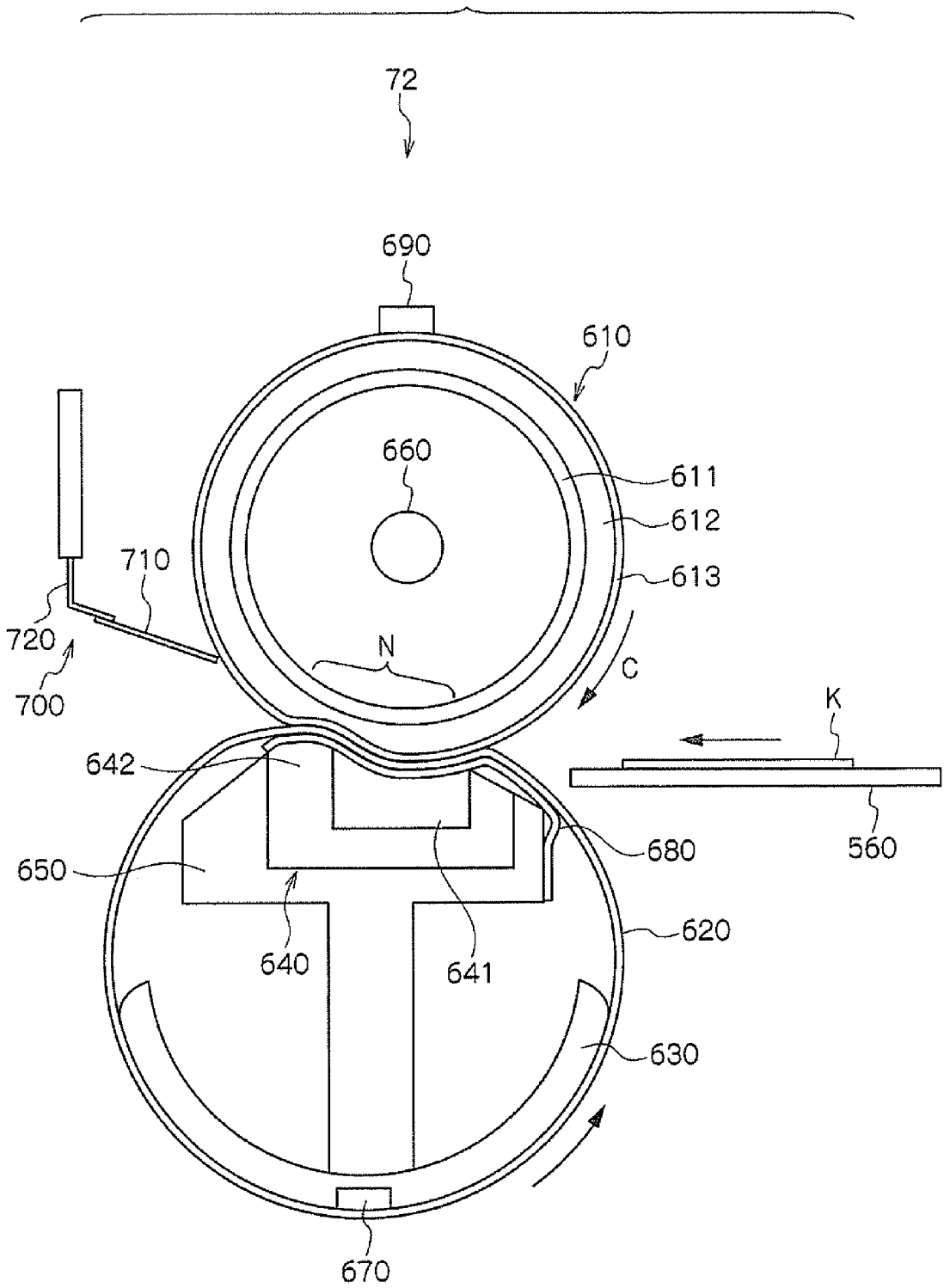
FIG. 6 is a schematic configurational view showing an image forming apparatus that uses an endless belt according to the exemplary embodiment.

FIG. 6 is a schematic configurational diagram of a fixing unit 72 disposed inside of an image forming apparatus 101 according to the present exemplary embodiment. A fixing unit 72 shown in FIG. 6 includes a fixing roll 610 as a rotation-driving rotating body, an endless belt 620 (pressure belt), and a pressure pad 640 that is a pressure member that pressurizes a fixing roll 610 through an endless belt 620. The pressure pad 640 may relatively pressurize an endless belt 620 and a fixing roll 610. Accordingly, an endless belt 620 side may be pressurized by a fixing roll 610 or a fixing roll 610 side may be pressurized by an endless belt 620.

A fixing roll 610 is constituted by layering a heat resistant elastic layer 612 and a releasing layer 613 around a metallic core (cylindrical core metal) 611. Inside of a fixing roll 610, a halogen lamp 660 as an example of a heating unit that heats an unfixed toner image in a nip region is disposed. As a heating unit, other heating member that generates heat may be used without restricting to a halogen lamp.

On the other hand, on a surface of a fixing roll 610, a thermosensor 690 is disposed in contact therewith. Based on temperature measurements by the thermosensor 690, a halogen lamp 660 is on-off controlled to maintain a surface temperature of a fixing roll 610 at a preset temperature (for example, 150° C.).

An endless belt 620 is supported freely rotatable by a pressure pad 640 disposed inside thereof, a belt running guide 630 and a not shown edge guide. In a nip region N, an endless belt 620 is disposed in contact with a fixing roll 610 in a state pressurized relative to a fixing roll 610.

A pressure pad 640 is disposed inside of an endless belt 620 in a state pressurized against a fixing roll 610 through an endless belt 620 to form a nip region N with a fixing roll 610. In a pressure pad 640, a pre-nip member 641 is disposed on an inlet side of a nip region N to secure a wide nip region N and a peeling nip member 642 is disposed on an exit side of a nip region N to apply strain to a fixing roll 610.

Furthermore, a low friction sheet 680 is disposed on a surface of a pre-nip member 641 and a peeling nip member 642 that comes into contact with an endless belt 620 to reduce sliding resistance between an inner peripheral surface of an endless belt 620 and a pressure pad 640. A pressure pad 640 and a low friction sheet 680 are held by a metallic holder 650.

Furthermore, a belt running guide 630 is attached to a holder 650 so that an endless belt 620 may rotate smoothly. That is, a belt running guide 630 slides with an inner periphery surface of an endless belt 620; accordingly, a belt running guide 630 is formed of a material small in static friction coefficient. Furthermore, a belt running guide 630 is formed of a material low in thermal conductivity so as to be difficult to deprive an endless belt 620 of heat.

A fixing roll 610 is rotated in a direction of an arrow mark C by a not shown driving motor and following the rotation an endless belt 620 rotates in a direction opposite to a rotation direction of a fixing roll 610. That is, while a fixing roll 610 rotates clockwise in FIG. 6, an endless belt 620 rotates counterclockwise.

A paper sheet K having an unfixed toner image is guided by a fixing inlet guide 560 and transported to a nip region N. When a paper sheet K goes through a nip region N, a toner image on a paper sheet K is fixed owing to pressure applied to a nip region N and heat supplied from a fixing roll 610.

In a fixing unit 72 of the present exemplary embodiment, owing to a concave pre-nip member 641 following an outer peripheral surface of a fixing roll 610, in comparison with a configuration that does not have a pre-nip member 641, a wide nip region N is secured.

Furthermore, in a fixing unit 72 of the present exemplary embodiment, by disposing a peeling nip member 642 projected relative to an outer peripheral surface of a fixing roll 610, strain of a fixing roll 610 may be made locally larger in an exit region of a nip region N.

When a peeling nip member 642 is disposed like this, a fixed paper sheet K goes through strain formed locally large when going through a peeling nip region; accordingly, a paper sheet K is readily peeled off a fixing roll 610.

As an auxiliary unit for peeling, a peeling member 700 is disposed on a downstream side of a nip region N of a fixing roll 610. A peeling member 700 is held by a holder 720 in a state where a peeling baffle 710 comes close to a fixing roll 610 in a direction (counter direction) opposite to a rotation direction of a fixing roll 610.

In what follows, members other than an endless belt 620 used in a fixing unit 72 according to the exemplary embodiment will be detailed.

Regarding a fixing roll 610 as a fixing member, any shape, structure and magnitude thereof may be used by selecting from known ones depending on an object without particular restriction. A fixing roll 610 includes a cylindrical core 611, an elastic layer 612 formed on a surface thereof and a releasing layer 613 formed further on a surface of the elastic layer.

A fixing roll 610 is produced according to a known method. In general, a fixing roll 610 produced as shown below is used. That is, a metal mold for forming an elastic layer 612 is disposed around a cylindrical core 611, a liquid rubber is cast in a gap between a metal mold and a cylindrical core 611 and vulcanized to solidify, and a resin sleeve made of PFA is installed on a surface.

As a cylindrical core 611 and a releasing layer 613, the same core and releasing layer as those used in the roll previously described as one example of a tubular body of the exemplary embodiment may be used.

A material of an elastic layer 612 is selected from existing materials and any material may be used as long as it is an elastic body high in heat resistance. In particular, an elastic body such as a rubber or an elastomer having rubber hardness substantially from 15 to 45° (JIS-A) may be used, for example, a silicone rubber and a fluororubber being exemplified. As a material for an elastic layer 612, among these, a silicone rubber may be used from the viewpoint of smaller surface tension and more excellent elasticity. As the silicone rubber, for example, RTV silicone rubber and HTV silicone rubber are exemplified. Specific examples thereof include polydimethyl silicone rubber (MQ), methylvinyl silicone rubber (VMQ), methylphenyl silicone rubber (PMQ) and fluoro silicone rubber (FVMQ).

A thickness of an elastic layer 612 may be 3 mm or less, or in the range of from 0.5 to 1.5 mm. In a fixing unit 72 in the first exemplary embodiment, HTV silicone rubber having rubber hardness of 35° (JIS-A) is coated on a core at a thickness of 72 μm As a heater for heating a fixing roll 610, as mentioned above, for example, a halogen lamp 660 is used. Any halogen lamp 660 may be used according to an object without particular restriction as long as it has a shape and a structure that may be housed inside of the core. A surface temperature of a fixing roll 610 heated by a halogen lamp 660 is measured with a thermosensor 690 disposed to a fixing roll 610 and a temperature thereof is controlled constant by a controller. A thermosensor 690 is not particularly restricted. For example, a thermistor and a temperature sensor are exemplified.

A pressure pad 640 disposed inside of an endless belt 620 is, as mentioned above, constituted of a pre-nip member 641 and a peeling nip member 642 and supported by a holder 650 so that a spring or an elastic body may press a fixing roll 610 at a load of, for example, 32 kgf. A surface on a side of a fixing roll 610 is formed with a concave curved surface following an outer peripheral surface of a fixing roll 610. The respective materials may be constituted of a heat resistant material from the viewpoint of inhibiting the material from deteriorating owing to heat during fixing.

A pressure pad 640 disposed inside of an endless belt 620 is not particularly restricted in a shape or a material as long as a pressure pad 640 has a function of pressurizing a fixing roll 610 via an endless belt 620 to form, between an endless belt 620 and a fixing roll 610, a nip region N where a paper sheet K holding an unfixed toner image goes through. Furthermore, in addition to a pressure pad 640, a pressure roller rotating while pressing against a fixing roll 610 may be disposed side by side.

In a pre-nip member 641, a heat resistant elastomer such as silicone rubber or fluororubber or an elastic body such as a plate spring maybe used. Among these materials, silicone rubber may be used from the viewpoint of excellent elasticity. As the silicone rubber, for example, RTV silicone rubber and HTV silicone rubber are exemplified. Specifically, examples thereof include polydimethyl silicone rubber (MQ), methylvinyl silicone rubber (VMQ), methylphenyl silicone rubber (PMQ) and fluoro silicone rubber (FVMQ). Silicone rubber having JIS-A hardness from 10 to 40° may be used from the viewpoint of hardness. A shape, structure and magnitude of an elastic body are selected depending on an object without particular restriction. In a fixing unit 72 of the exemplary embodiment, silicone rubber having a width of 10 mm, a thickness of 5 mm and a length of 320 mm is used.

A peeling nip member 642 is formed of a heat resistant resin such as PPS (polyphenylene sulfide), polyimide, polyester or polyamide or a metal such as iron, aluminum or SUS. The peeling nip member is formed to have a convex curved surface where a shape of an outer surface in a nip region N has a constant curvature radius. In a fixing unit 72 of the exemplary embodiment, an endless belt 620 is lapped by a pressure pad to a fixing roll 610 at a winding angle of 40° to form a nip region N having a width of 8 mm.

A low friction sheet 680 is disposed to reduce sliding resistance (frictional resistance) between an inner peripheral surface of an endless belt 620 and a pressure pad 640. A material low in a friction coefficient and excellent in wear resistance and heat resistance is suitable.

As a material of the low friction sheet 680, various materials such as metals, ceramics and resins are adopted. Specific examples thereof include, in addition to a fluororesin that is a heat resistant resin, polyether sulfone (PES), polybutylene terephthalate (PBT), liquid crystal polymer (LCP), polyphenylene sulfide (PPS) and polyethylene terephthalate (PET), a natural material such as 6-nylon or 6,6-nylon and a material obtained by adding carbon or glass fiber thereto is used.

Among these, a fluororesin sheet in which a side of a contact surface with an endless belt 620 has small sliding resistance and a surface holding a lubricant has a fine irregular shape may be used.

Specific examples thereof include a sintered PTFE resin sheet, a glass fiber sheet impregnated with Teflon®, a layered sheet obtained by sandwiching by heating and fusing a skived film sheet made of a fluororesin to a glass fiber, and a fluororesin sheet having streaky irregularity.

A low friction sheet 680 may be constituted separately from a pre-nip member 641 or a peeling nip member 642 or may be constituted integrally with a pre-nip member 641 or a peeling nip member 642.

Furthermore, in a holder 650, over a longer direction of a fixing unit 72, a lubricant coating member 670 is disposed. A lubricant coating member 670 is disposed so as to come into contact with an inner peripheral surface of an endless belt 620 to supply an appropriate amount of a lubricant. Thereby, a lubricant is fed to a sliding portion between an endless belt 620 and a low friction sheet 680 to further reduce sliding resistance between an endless belt 620 and a pressure pad via a low friction sheet 680 to realize a smooth rotation of an endless belt 620. Furthermore, wear of an inner peripheral surface of an endless belt 620 and a surface of a low friction sheet 680 as well is suppressed.

As a lubricant, silicone oil may be used. Examples of the silicone oil include dimethyl silicone oil, organometallic salt-added dimethyl silicone oil, hindered amine-added dimethyl silicone oil, organometallic salt- and hindered amine-added dimethyl silicone oil, methylphenyl silicone oil, amino-modified silicone oil, organometallic salt-added amino-modified silicone oil, hindered amine-added amino-modified silicone oil, carboxy-modified silicone oil, silanol-modified silicone oil, and sulfone acid-modified silicone oil. Among these, amino-modified silicone oil may be used because it is excellent in wettability.

In an image fixing unit 72 of the exemplary embodiment, a lubricant is fed to an inner peripheral surface of an endless belt 620 from a lubricant coating member 670. However, an embodiment where a lubricant coating member and a lubricant are not used as well may be adopted.

When a more excellent heat resistance property is necessary, methylphenyl silicone oil or fluorooil (perfluoropolyether oil, modified perfluoropolyether oil) may be used. An antioxidant may be added to silicone oil to improve heat resistance. Other than what is mentioned above, synthetic lubricant grease obtained by mixing a solid material and a liquid, for example, silicone grease, fluorogrease and combinations thereof, may be used. In a fixing unit 72 of the exemplary embodiment, amino-modified silicone oil having viscosity of 300 cs (trade name: KF 96, manufactured by Shin-Etsu Chemical Co., Ltd.) is used.

A belt running guide 630 slides, as mentioned above, with an inner peripheral surface of an endless belt 620. Accordingly, a material low in frictional coefficient and low in thermal conductivity so as to be difficult to deprive an endless belt 620 of heat may be used, heat resistant resin such as PFA or PPS being used.

In an image forming apparatus 101 of the exemplary embodiment, an endless belt that is a tubular body of the foregoing exemplary embodiment is used as an endless belt 620 of a fixing unit 72. Accordingly, a tubular body supporting unit of the present exemplary embodiment that contains a tubular body of the foregoing exemplary embodiment includes an endless belt 620, a pressure pad 640 disposed inside of an endless belt 620 and a belt running guide 630.

In an image forming apparatus 101 of the present exemplary embodiment, an endless belt that is a tubular body of the foregoing exemplary embodiment is used as an endless belt 620 of a fixing unit 72. However, as a fixing roll 610 of a fixing unit 72, a roll (roll not having an elastic layer 612) that is a tubular body of the foregoing exemplary embodiment may be used.

In an image forming apparatus 101 of the present exemplary embodiment, an endless belt that is a tubular body of the foregoing exemplary embodiment may be used as an intermediate transfer belt 86. In this case, a belt supporting unit 90 formed from an intermediate transfer belt 86, a support roll 73 disposed on an inner surface side thereof, a support roll 74 and a driving roll 81 is a tubular body supporting apparatus of the present exemplary embodiment.

In an image forming apparatus 101 of the present exemplary embodiment, at least a tubular body of the foregoing exemplary embodiment may be used, and plural tubular bodies of the foregoing exemplary embodiment may be combined and used.

Second Exemplary Embodiment

An image forming apparatus of a second exemplary embodiment is an embodiment where, in place of a fixing unit 72 disposed in an image forming apparatus 101 of the first exemplary embodiment, a fixing unit provided with a fixing belt (endless belt of the foregoing exemplary embodiment) with a heater and a pressure roll is used. Items other than that a fixing unit is different are same as that mentioned above; accordingly, descriptions thereof will be omitted.

—Fixing Unit (Image Fixing Apparatus)—

Figure 7:
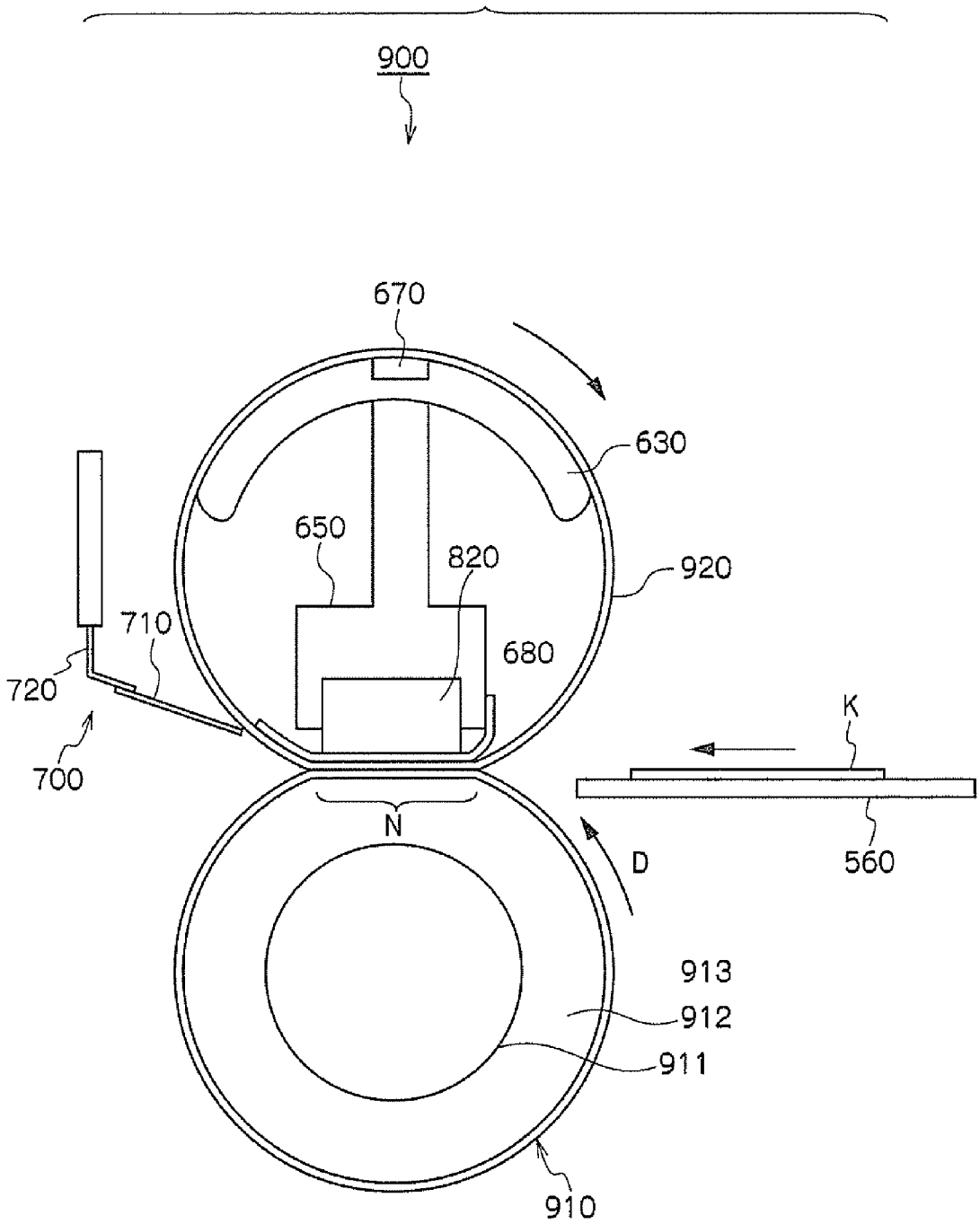
FIG. 7 is a schematic configurational view showing another image forming apparatus that uses an endless belt according to the exemplary embodiment.

FIG. 7 is a schematic configurational diagram of a fixing unit of the present exemplary embodiment. Concerning configurations same as a fixing unit according to a first exemplary embodiment, same reference numerals will be given and detailed descriptions thereof will be omitted.

As shown in FIG. 7, a fixing unit 900 according to a second exemplary embodiment is configured by including a fixing belt 920 as an endless belt and a pressure roll 910 as one example of a rotating body that is rotation-driven. A fixing belt 920 is constituted same as the foregoing endless belt 620.

A fixing belt 920 is disposed on a side of a toner image holding surface of a paper sheet K, a ceramic heater 820 that is a resistance heater as one example of a heating unit is disposed inside of a fixing belt 920, and thereby heat is supplied from a ceramic heater 820 to a nip region N.

In a ceramic heater 820, a surface on a side of a pressure roll 910 is formed flat. A ceramic heater 820 is disposed in a state pressed against a pressure roll 910 through a fixing belt 920 to form a nip region N. Accordingly, a ceramic heater 820 works also as a pressure member. A paper sheet K which has gone through a nip region N is peeled off a fixing belt 920 owing to a change of curvature of a fixing belt 920 at an exit region (peeling nip region) of a nip region N.

Furthermore, between an inner peripheral surface of a fixing belt 920 and a ceramic heater 820, a low friction sheet 680 is disposed to reduce sliding resistance between an inner peripheral surface of a fixing belt 920 and a ceramic heater 820. The low friction sheet 680 may be constituted either separately from a ceramic heater 820 or integrally with a ceramic heater 820.

On the other hand, a pressure roll 910 is disposed so as to face a fixing belt 920 and rotated in a direction of an arrow mark D by a not shown driving motor, and a fixing belt 920 is rotated following the rotation. A pressure roll 910 is constituted by layering a core (cylindrical core metal) 931, a heat resistant elastic layer 912 coating an outer peripheral surface of a core 911 and a releasing layer 913 formed of a heat resistant resin coating or a heat resistant rubber coating, and, as required, the respective layers are rendered semiconductive by addition of carbon black in order to prevent toner offset.

As an auxiliary unit for peeling, on a downstream side of a nip region N of a fixing belt 920, a peeling member 700 may be disposed. A peeling member 700 is held by a holder 720 in a state where a peeling baffle 710 comes close to a fixing belt 920 in a direction (counter direction) opposite to a rotation direction of a fixing belt 920.

A paper sheet K having an unfixed toner image thereon is guided by a fixing inlet guide (not shown) to a nip region N of a fixing unit 900. When a paper sheet K goes through a nip region N, a toner image on a paper sheet K is fixed owing to pressure applied to a nip region N and heat supplied from a ceramic heater on a side of a fixing belt 920.

Herein, in a fixing unit 900 of the present exemplary embodiment, a pressure roll 910 is formed into an inverse crown shape (flare shape) where outer diameters at both ends are larger than an outer diameter of a center portion, a fixing belt 920 as well has an irregular shape on an inner surface thereof, and the irregular shape is constituted so as to expand and deform into a shape following a surface shape of the pressure roll 910 in a nip region. By thus configuring, when a paper sheet goes through a nip region, a tensile force acts in a width direction from a center portion toward both end portions of a paper sheet by a pressure roll 910 to expand a paper sheet, and a length in a surface width direction of a fixing belt 920 as well expands.

Accordingly, in a fixing unit 900 of the present exemplary embodiment as well, in an entire region over from a center region to both end portions, a fixing belt 920 is inhibited from slipping relative to a paper sheet K.

As a source of heat, other than a ceramic heater 820, a halogen lamp disposed inside of a fixing belt 920 or electromagnetic induction heat generation caused by an electromagnetic induction coil disposed inside or outside of a fixing belt 920 may be used.

Inside of a fixing belt 920, in addition to a flat pressure member, a pressure roller that rotates with pressure applying against a pressure roll 910 may be disposed side by side.

In an image forming apparatus of the present exemplary embodiment, as a fixing belt 920 of a fixing unit 900, an endless belt that is a tubular body of the foregoing exemplary embodiment is used. Accordingly, a tubular body supporting apparatus of the present exemplary embodiment containing a tubular body of the foregoing exemplary embodiment includes a fixing belt 920, a ceramic heater 820 disposed inside of a fixing belt 920 and a belt running guide 630.

In an image forming apparatus of the present exemplary embodiment, as a fixing belt 920 of a fixing unit 900, an endless belt that is a tubular body of the foregoing exemplary embodiment is used. However, as a fixing roll 910 of a fixing unit 900, a roll that is a tubular body of the foregoing exemplary embodiment may be used. Furthermore, an image forming apparatus of the present exemplary embodiment may use at least a tubular body of the foregoing exemplary embodiment and may use a combination of plural tubular bodies of the foregoing exemplary embodiment.

Third Exemplary Embodiment

In the next place, an image forming apparatus of a third exemplary embodiment, where an endless belt that is a tubular body of the foregoing exemplary embodiment is used as a paper sheet conveying belt, will be described.

Figure 8:
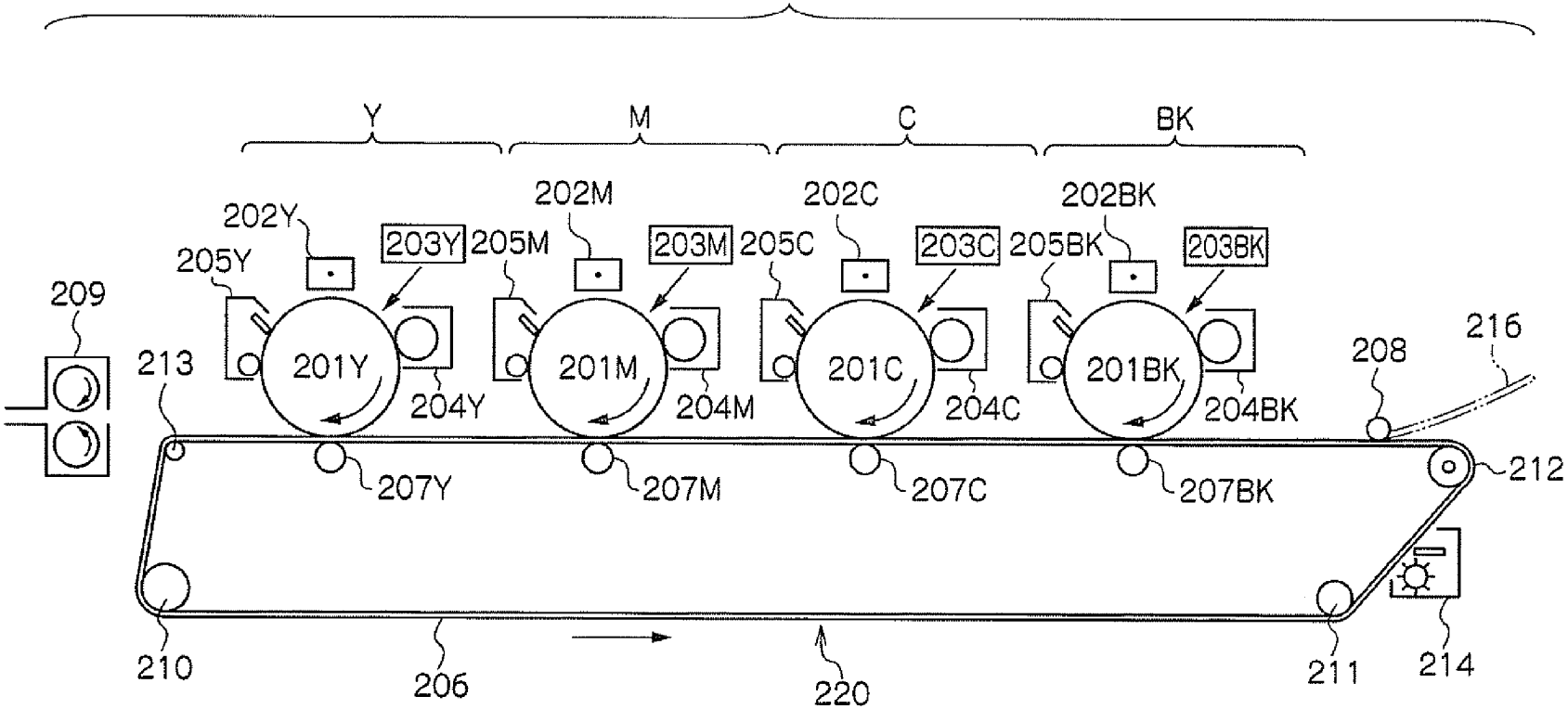
FIG. 8 is a schematic configurational view showing an image forming apparatus that uses an endless belt according to the exemplary embodiment as a paper sheet conveying belt.

FIG. 8 is a schematic diagram showing an image forming apparatus according to a third exemplary embodiment. In an image forming apparatus shown in FIG. 8, units Y, M, C and BK, respectively are provided with photoreceptor drums 201Y, 201M, 201C and 201BK that rotate clockwise as shown by an arrow mark. Around photoreceptor drums 201Y, 201M, 201C and 201BK, charging rolls 202Y, 202M, 202C and 202BK, exposing units 203Y, 203M, 203C and 203BK, developing units for respective colors (yellow developing unit 204Y, magenta developing unit 204M, cyan developing unit 204C and black developing unit 204BK), and photoreceptor drum cleaning members 205Y, 205M, 205C and 205BK are disposed respectively.

Units Y, M, C and BK are disposed in parallel to a paper sheet conveying belt 206 respectively and in an order of units BK, C, M, and Y. However, an order of units BK, Y, C and M may be set in an appropriate order in accordance with an image forming method.

A paper sheet conveying belt 206 is bridged with tension applied from a side of an inner surface by belt support rolls 210, 211, 212, and 213 to form a belt supporting unit 220 for an image forming apparatus. The paper sheet conveying belt 206 rotates at a circumferential speed same as photoreceptor drums 201Y, 201M, 201C and 201BK in a counterclockwise direction shown by an arrow mark, and a part thereof located between belt support rolls 212 and 213 is disposed so as be in contact with photoreceptor drums 201Y, 201M, 201C and 201BK, respectively. A paper sheet conveying belt 206 is provided with a belt cleaning member 214.

Transfer rolls 207Y, 207M, 207C and 207BK respectively are disposed at positions that are inside of a paper sheet conveying belt 206 and face portions where a paper sheet conveying belt 206 and photoreceptor drums 201Y, 201M, 201C and 201BK are in contact, and forms a transfer region that transfers a toner image to a paper sheet (transfer receiving medium) 216 together with photoreceptor drums 201Y, 201M, 201C and 201BK and a paper sheet conveying belt 206. Transfer rolls 207Y, 207M, 207C and 207BK, respectively, may be disposed, as shown in FIG. 8, either immediate below photoreceptor drums 201Y, 201M, 201C and 201BK or at positions slightly deviated from immediate below photoreceptor drams 201Y, 201M, 201C and 201BK.

A fixing unit 209 is disposed so that a paper sheet is transported thereto after going through respective transfer regions between a paper sheet conveying belt 206 and photoreceptor drums 201Y, 201M, 201C and 201BK.

A paper sheet 216 is transported by a paper sheet conveying roll 208 to a paper sheet conveying belt 206.

In an image forming apparatus according to a third exemplary embodiment shown in FIG. 8, in unit BK, a photoreceptor drum 201BK is rotation-driven. Following this, a charging roll 202BK is driven to charge a surface of a photoreceptor drum 201BK to target polarity and potential. A photoreceptor drum 201BK of which surface is charged is then exposed imagewise by an exposing unit 203BK to form an electrostatic latent image on a surface thereof.

Subsequently, the electrostatic latent image is developed by a black developing unit 204BK. Thereby, on a surface of a photoreceptor drum 201BK, a toner image is formed. At this time, a developer may be either a single component developer or a two-component developer.

When the toner image goes through a transfer region of a photoreceptor drum 201BK and a paper sheet conveying belt 206, a paper sheet 216 electrostatically adsorbing to a paper sheet conveying belt 206 is conveyed to the transfer region, so that the toner image is transferred to a surface of a paper sheet 216 under an electric field formed by a transfer bias applied from a transfer roll 207BK.

Thereafter, a toner remaining on a photoreceptor drum 201BK is cleansed and removed by a photoreceptor drum cleaning member 205BK. A photoreceptor drum 201BK is supplied to a subsequent image transfer.

The image transfer operation mentioned above is conducted in a similar manner in units C, M and Y as well.

A paper sheet 216 onto which toner images are transferred by transfer rolls 207BK, 207C, 207M and 207Y is further transported to a fixing unit 209 and fixed.

According to a manner mentioned above, an intended image is formed on a paper sheet.

In an image forming apparatus of the present exemplary embodiment, an endless belt that is a tubular body of the foregoing exemplary embodiment is used as a paper sheet conveying belt 206. Accordingly, a tubular body supporting apparatus of the present exemplary embodiment containing a tubular body of the foregoing exemplary embodiment is a belt supporting unit 220 formed of a paper sheet conveying belt 206 and belt support rolls 210, 211, 212 and 213 disposed inside of a paper sheet conveying belt 206.

EXAMPLES

In what follows, the present invention will be described specifically with reference to Examples. However, the respective Examples do not restrict the invention.

Example 1

In the beginning, as a polyamide acid solution, a solution containing polyamide acid obtained by reacting 3,3',4,4'-biphenyltetracarboxylic dianhydride and p-phenylenediamine in N-methyl-2-pyrrolidone (NMP) and having a solid concentration of 18% (% by weight, ditto hereinafter) and viscosity of 20 Pa·s is prepared.

In the next place, the polyamide acid solution is coated on a surface of a cylindrical aluminum mold (cylindrical core body) having an inner diameter of 30 mm and a length of 450 mm and thereby a coating liquid film (first coating liquid film) is formed. A fluorine-based releasing agent is coated in advance on a surface of the cylindrical metal mold to improve peelability after a belt is formed.

A cylindrical core body on which a coating liquid film is formed is put into a drying furnace set at 100° C. while rotating at 20 rpm. When it was taken out after 60 min, a semidry polyimide precursor coating film is formed and a residual solvent is 40% (by weight ratio). In this state, a coating film cannot be peeled off a core body.

In the next place, 20 g of barium sulfate (trade name: BMH-60, manufactured by Sakai Chemical Industry Co., Ltd., volume average particle diameter: 6 μm, form: amorphous) is mixed in 100 g of water to prepare barium sulfate mixed water. Then, the prepared barium sulfate mixed water is charged in a DIA SPRAY (trade name, manufactured by FURUPLA Co., Ltd.) and sprayed to the semidry polyimide precursor coating film. A liquid droplet diameter of barium sulfate mixed water at the time of spraying is 80 μm on an average. At this time, while rotating a cylindrical core body at 20 rpm, a sprayer is moved at a constant speed to spray not so as to spray too much at the same position (liquid droplet applying step). After spraying, a cylindrical core body is left at 25° C. for 30 min while rotating at 20 rpm, followed by wiping NMP mixed water (a mixture of NMP contained in a polyamide acid solution and water contained in barium sulfate mixed water) attached on a surface of a polyimide precursor coating film.

On the other hand, PTFE aqueous paint containing water as a solvent (fluororesin dispersion liquid, concentration: 60%, viscosity: 200 mPa·s) is prepared. The paint is coated on the polyimide precursor coating film by a helical coating method, followed by drying for 10 min in a calm dryer set at 80° C.

In the next place, a metal mold (cylindrical core body on which a polyimide precursor coating film is formed, and PTFE aqueous paint is further coated thereon) is put in an oven, heated stepwise up to 350° C. to imidize the polyimide precursor coating film. A stepwise heating is conducted by keeping for 1 hr at 160° C., for 30 min at 250° C. and for 1 hr at 350° C.

In the next place, the metal mold is left to stand at room temperature (25° C.), a resin is removed from the metal mold, and thereby a multi-layered endless belt where a fluororesin having a film thickness of 20 μm and a polyimide resin having a film thickness of 100 μm are layered is obtained.

A produced multi-layered endless belt is cut at a width of 20 mm, followed by partially peeling a fluororesin layer off a polyimide layer, further followed by measuring peel strength by use of a tensile tester (trade name: EZ Graph, manufactured by Shimadzu Corporation) with peeled fluororesin layer and polyimide resin layer clipped. As the result, peel strength is 0.90 kgf and adhesive strength is such strong as that a fluororesin layer is broken before an entire surface of a fluororesin is peeled.

A surface layer of a produced multi-layered endless belt is removed by scrubbing with a plastic chip, followed by observing a surface of a polyimide resin layer (substrate) with a scanning electron microscope. As the result, it is found that particles are embedded in an inner surface of a concave portion, an average diameter of concave portions is 50 μm, an average depth of the concave portion is 20 μm, a shape of the concave portion is a hemisphere, a number of the concave portions present on a surface of a substrate is 10 per 1 $mm^2$ of an area on an average, and a number of particles per one concave portion is 10 on an average. Furthermore, surface roughness of a substrate is measured in a manner same as mentioned above and found that Ra is 2 μm Example 2

In a manner similar to Example 1, a polyimide precursor coating film is formed, and aluminum oxide mixed water is prepared by mixing, in place of barium sulfate, 20 g of aluminum oxide (trade name: A-42-2, manufactured by Showa Denko K. K., volume average particle diameter: 5 μm, form: amorphous) with 100 g of water. The aluminum oxide mixed water is sprayed (liquid droplet diameter: 100 μm) and left to stand in a manner similar to Example 1, followed by coating PTFE aqueous paint, further followed by drying and baking, and thereby a multi-layered endless belt is obtained.

Peel strength of the produced multi-layered endless belt is measured and found to be 0.85 kgf and a fluororesin layer is broken during a peel test. A number of particles per one concave portion is 12 on an average.

Example 3

In a manner similar to Example 1, a polyimide precursor coating film is formed, and silicon carbide mixed water is prepared by mixing, in place of barium sulfate, 20 g of silicon carbide (trade name: GC#3000, manufactured by Fujimi Incorporated, volume average particle diameter: 4.8 μm, form: amorphous) with 100 g of water. In a manner similar to Example 1, the silicon carbide mixed water is sprayed (liquid droplet diameter: 80 μm) and left to stand, followed by coating PTFE aqueous paint, further followed by drying and baking, thereby a multi-layered endless belt is obtained.

Peel strength of the produced multi-layered endless belt is measured and found to be 0.95 kgf and a fluororesin layer is broken during a peel test. A number of particles per one concave portion is 8 on an average.

Example 4

In a manner similar to Example 1, a polyimide precursor coating film is formed and fluororesin particle mixed water is prepared by mixing, in place of barium sulfate, 20 g of fluororesin particles (product name: LUBRON™ L-5, manufactured by Daikin Industries Ltd., volume average particle diameter: 5.0 μm, form: amorphous) with 100 g of water. In a manner similar to Example 1, the fluororesin particle mixed water is sprayed (liquid droplet diameter: 90 μm) and left to stand, followed by coating PTFE aqueous paint, further followed by drying and baking, and thereby a multi-layered endless belt is obtained.

Peel strength of the produced multi-layered endless belt is measured and found to be 1.00 kgf and a fluororesin layer is broken during a peel test. A number of particles per one concave portion is 10 on an average.

Example 5

In a manner similar to Example 1, a polyimide precursor coating film is formed, and barium sulfate mixed water is sprayed, followed by putting in an oven set at 80° C. for 30 min. After taking out after 30 min, in a manner similar to Example 1, PTFE aqueous paint is coated, dried and baked, and thereby a multi-layered endless belt is obtained.

Peel strength of the produced multi-layered endless belt is measured and found to be 0.67 kgf and a fluororesin layer is broken during a peel test.

A surface of a polyimide resin layer (substrate) of a produced multi-layered endless belt is observed in a manner similar to Example 1 and found that particles are embedded in an inner surface of a concave portion, an average diameter of concave portions is 60 (am, an average depth of the concave portion is 20 μm, a shape of the concave portion is a hemisphere, a number of the concave portions present on a surface of a substrate is 10 per 1 $mm^2$ on an average and a number of particles per one concave portion is 7 on an average. Furthermore, surface roughness of a substrate is measured in a manner similar to Example 1 and found that Ra is 2.5 μm.

Example 6

In a manner similar to Example 1, a polyimide precursor coating film is formed, and alumina particle mixed water is prepared by mixing, in place of barium sulfate, 20 g of an alumina polishing agent (product name: WHITE MOLANDOM, manufactured by Showa Denko K. K., volume average particle diameter: 14 μm, form: amorphous) with 100 g of water. In a manner similar to Example 1, the alumina particle mixed water is sprayed (liquid droplet diameter: 30 μm) and left to stand, followed by coating PTFE aqueous paint, further followed by drying and baking, thereby a multi-layered endless belt is prepared.

Peel strength of the produced multi-layered endless belt is measured and found to be 0.85 kgf and a fluororesin layer is broken during a peel test.

A surface of a polyimide resin layer (substrate) of a produced multi-layered endless belt is observed in a manner similar to Example 1 and found that particles are embedded in an inner surface of a concave portion, an average diameter of concave portions is 18 μm, an average depth of the concave portion is 15 μm, a shape of the concave portion is a hemisphere, a number of the concave portions present on a surface of a substrate is 13 per 1 $mm^2$ on an average and a number of particles per one concave portion is 1 on an average. Furthermore, surface roughness of a substrate is measured in a manner similar to Example 1 and found that Ra is 2.0 μm.

Example 7

In a manner similar to Example 1, a polyimide precursor coating film is formed, barium sulfate mixed water is sprayed and left to stand, followed by coating acryl resin paint (acryl resin dispersion liquid, concentration: 50%, viscosity: 220 mPa·s) in place of PTFE aqueous paint, further followed by drying and baking, thereby a multi-layered endless belt is obtained.

Peel strength of the produced multi-layered endless belt is measured and found to be 0.79 kgf and a fluororesin layer is broken during a peel test.

A surface of a polyimide resin layer (substrate) of a produced multi-layered endless belt is observed in a manner similar to Example 1 and found that particles are embedded in an inner surface of a concave portion, an average diameter of concave portions is 40 μm, an average depth of the concave portion is 20 μm, a shape of the concave portion is a hemisphere, a number of the concave portions present on a surface of a substrate is 8/1 $mm^2$ on an average and a number of particles per one concave portion is 9 on an average. Furthermore, surface roughness of a substrate is measured in a manner similar to Example 1 and found that Ra is 1.8 μm.

Reference Example 1

A polyimide precursor coating film is formed in a manner similar to Example 1, followed by spraying water (liquid droplet diameter: 70 μm) in place of barium sulfate mixed water, further followed by leaving to stand, followed by coating PTFE aqueous paint, further followed by drying and baking, and thereby a multi-layered endless belt is obtained.

Peel strength of the produced multi-layered endless belt is measured and found to be 0.52 kgf and a fluororesin layer is broken during a peel test.

Reference Example 2

A polyimide precursor coating film is formed in a manner similar to Example 5, followed by spraying water (liquid droplet diameter: 65 μm) in place of barium sulfate mixed water, further followed by putting in an oven set at 80° C. for 30 min, followed by taking out after 30 min, further followed by coating PTFE aqueous paint in a manner similar to Example 5, followed by drying and baking, and thereby a multi-layered endless belt is obtained.

Peel strength of the produced multi-layered endless belt is measured and found to be 0.61 kgf and a fluororesin layer is broken during a peel test.

Comparative Example 1

A polyimide precursor coating film is formed in a manner similar to Example 1, followed by, without applying a spraying step, coating PTFE paint, further followed by drying and baking to form a multi-layered endless belt.

Peel strength of a produced multi-layered endless belt is measured and found to be 0.12 kgf. This is the strength to an extent where, when an ordinary Kapton® tape (registered trade mark, manufactured by Permacel® Inc.) is attached to a surface of a fluororesin and peeled, a fluororesin layer is completely peeled, and adhesive strength to an extent where, when the endless belt is used as a fixing belt, the endless belt is readily peeled and broken. A surface of peeled polyimide is such smooth as having high glossiness.

Comparative Example 2

After a polyimide precursor coating film is formed in a manner similar to Example 1, barium sulfate (trade name: BMH-60, manufactured by Sakai Chemical Industries Co., Ltd, particle diameter: 6 μm) is dry-sprayed without mixing with water. As the result, barium sulfate hardly attaches to a surface of a polyimide precursor coating film. Then, when barium sulfate is dry-sprayed with a strong wind, barium sulfate powder is attached at strength to an extent where barium sulfate powder falls when a coating film is vibrated. Furthermore, pinholes are generated in a polyimide precursor coating film. PTFE paint is coated on the polyimide precursor coating film, followed by drying and baking, and thereby a multi-layered endless belt is obtained.

When peel strength of a produced multi-layered endless belt is measured, the peel strength is 0.15 kgf. When a Kapton® tape is bonded and peeled, a fluororesin layer is readily peeled. Furthermore, a surface of the peeled polyamide is smooth and a formed concave portion is not found thereon.

Comparative Example 3

After a polyimide precursor coating film is formed in a manner similar to Example 1, the polyimide precursor coating film is dipped in water where barium sulfate (trade name: BMH-60, manufactured by Sakai Chemical Industries Co., Ltd, particle diameter: 6 μm) is mixed and dispersed. After 1 min, the polyimide precursor coating film is taken out and dried at 25° C. for 3 hr, followed by coating PTFE paint, further followed by drying and baking, and thereby a multi-layered endless belt is obtained.

A produced multi-layered endless belt is cracked at ends thereof. When peel strength is measured, it is found to be 0.14 kgf and a surface of the polyimide after the fluororesin layer is peeled is smooth. Furthermore, when a cross section is observed with a scanning electron microscope (trade name; JSM-6390A, manufactured by JEOL. Ltd.), barium sulfate particles are not found at an interface between a fluororesin and polyimide. This is because an electric repulsion force is generated between the polyimide precursor coating film and barium sulfate dispersed in water and thereby barium sulfate does not adhere to a surface of the polyimide precursor coating film.

Each of endless belts prepared in the Examples 1 to 7 is used as an endless belt 620 of an image fixing apparatus shown in FIG. 6 in an image forming apparatus shown in FIG. 5 to form an image. Since a surface layer of an endless belt 620 is difficult to peel, an excellent image is formed over a long period of time.

From results mentioned above, it is found that in Examples, a surface layer of an endless belt is difficult to peel in comparison with Comparative Examples.

Furthermore, it is found that, in Examples and Reference Examples, when a method for producing a tubular body in the Exemplary Embodiment is used, a tubular body having a substrate having concave portions on a surface and a surface layer is readily prepared.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A tubular body comprising:

a substrate including concave portions having one of a shape of a hemisphere, a cylinder, and an ellipse on a surface thereof;

a surface layer formed on the surface of the concave portion-including side of the substrate, the surface layer having a thickness in a range of 5 μm to 400 μm; and a plurality of particles positioned at an interface between the substrate and the surface layer in each of the concave portions, wherein an average diameter of the concave portions is from about 0.01 μm to about 1,000 μm, a volume average particle diameter of the particles is from about 0.01 μm to about 15 μm, and the average diameter of the concave portions is from about 1 to about 10,000 times the volume average particle diameter of the particles, and a glass transition temperature of the surface layer is in a range of 100° C. to 200° C.

2. The tubular body of claim 1, wherein the substrate contains a polyimide resin, and the surface layer contains a fluororesin.

3. The tubular body of claim 1, wherein a plurality of particles are positioned at the interface in each of the concave portions.

4. The tubular body of claim 1, wherein a number of the concave portions present on the surface of the substrate is from about 1 to about 1,000 per 1 $mm^2$ of an area of the surface of the substrate.

5. The tubular body of claim 1, wherein a number of the particles positioned at an inner surface of each of the concave portions is from about 1 to about 10,000.

6. A tubular body supporting apparatus comprising:

the tubular body of claim 1; and a plurality of supporting members that support the tubular body with tension applied from inside thereof.

7. An image fixing apparatus comprising a first rotating body, and a second rotating body in contact with the first rotating body, at least one of the first rotating body or the second rotating body being the tubular body of claim 1.

8. An image forming apparatus comprising:

a latent image holder;

a latent image forming unit that forms a latent image on a surface of the latent image holder;

a developing unit that develops the latent image with a toner to form a toner image;

a transfer unit that transfers the toner image to a recording medium; and a fixing unit that fixes the toner image on the recording medium, at least one of the transfer unit or the fixing unit including the tubular body of claim 1.

9. The tubular body of claim 1, wherein between 5 to 500 particles are positioned at the interface in each of the concave portions.

10. The tubular body of claim 1, wherein a surface roughness Ra of the substrate including concave portions on a surface thereof is from 0.01 μm to 20 μm in measurement conditions where (i) a shape of a stylus tip is θ=90° conical stylus, (ii) a diameter of the stylus tip is tip r (tip)=2 μm, and (iii) a scanning length is 10.0 mm.

11. The tubular body of claim 1, wherein the widest part of the concave portion is at the surface of the substrate.

12. The tubular body of claim 1, wherein the glass transition temperature is measured using a differential scanning calorimeter based on JIS 7121-1987.

13. The tubular body of claim 1, wherein the surface layer contains a fluororesin material.

* * * * *